US009416563B1

(12) United States Patent
Wind et al.

(10) Patent No.: US 9,416,563 B1
(45) **Date of Patent: *Aug. 16, 2016**

(54) COMBINATION LOCK WITH ROTARY LATCH

(75) Inventors: Patrick E. Wind, Darien, CT (US); Kevin Houlihan, North Salem, NY (US); Douglas Greene, Bethel, CT (US)

(73) Assignee: ZEPHYR LOCK LLC, Danbury, CT (US)

( * ) Notice: Subject to any disclaimer, the term of this patent is extended or adjusted under 35 U.S.C. 154(b) by 1398 days.

This patent is subject to a terminal disclaimer.

(21) Appl. No.: 12/250,368

(22) Filed: Oct. 13, 2008

(51) Int. Cl.
*E05B 37/08* (2006.01)
*E05B 13/10* (2006.01)

(52) U.S. Cl.
CPC ..... *E05B 37/08* (2013.01); *E05B 13/10* (2013.01)

(58) Field of Classification Search
CPC ..... E05B 37/02; E05B 13/10; E05B 13/103; E05B 65/025
USPC ..... 70/303 A, 285; 292/DIG. 68
See application file for complete search history.

(56) References Cited

U.S. PATENT DOCUMENTS

| | | | |
|---|---|---|---|
| 13,722 | A | 10/1855 | Holmes et al. |
| 214,251 | A | 4/1879 | Ham |
| 257,725 | A | 5/1882 | Lalor |
| 307,281 | A | 10/1884 | Farrar |
| 558,547 | A | 4/1896 | Burrows, Jr. |
| 781,185 | A | 1/1905 | Campbell |
| 885,559 | A | 4/1908 | Woodward |
| 900,437 | A | 10/1908 | Soley |
| 900,438 | A | 10/1908 | Soley |
| 925,900 | A | 6/1909 | Hansen |
| 930,534 | A | 8/1909 | Cox |
| 1,036,348 | A | 8/1912 | Schmittberger |
| 1,466,489 | A | 8/1923 | Starrett |
| 1,592,405 | A | 7/1926 | Worley, Jr. et al. |
| 1,592,406 | A | 7/1926 | Worley, Jr. |
| 1,716,169 | A | 6/1929 | Hart |
| 1,774,783 | A | 9/1930 | Worley, Jr. et al. |
| 1,902,547 | A | 3/1933 | Endter |
| 2,002,453 | A | 5/1935 | North |
| 2,047,795 | A | 7/1936 | North |
| 2,112,982 | A | 4/1938 | Brauning |

(Continued)

FOREIGN PATENT DOCUMENTS

| | | |
|---|---|---|
| DE | 2342574 | 3/1975 |
| DE | 3437563 A1 | 4/1986 |

(Continued)

OTHER PUBLICATIONS

International Search Report for PCT/US07/15957, dated Jan. 9, 2008.

(Continued)

*Primary Examiner* — Suzanne Barrett
(74) *Attorney, Agent, or Firm* — Cantor Colburn LLP

(57) ABSTRACT

A combination lock is provided, the combination lock having a rotary latch configured for rotation between a locked position and an unlocked position, the rotary latch rotating in a first plane; and a bolt configured for movement between a first position and a second position along a second plane the second plane being oriented at a different location than the first plane, the bolt engaging the rotary latch in the first position such that rotation of the rotary latch from the locked position to the unlocked position is prevented.

17 Claims, 19 Drawing Sheets

(56) References Cited

U.S. PATENT DOCUMENTS

| | | | | | |
|---|---|---|---|---|---|
| 2,156,874 | A | | 5/1939 | Schonitzer | |
| 2,217,098 | A | | 10/1940 | Brownne | |
| 2,634,147 | A | | 4/1953 | Robertson | |
| 2,725,739 | A | | 12/1955 | Check | |
| 2,795,947 | A | | 6/1957 | Peras | |
| 2,910,859 | A | | 11/1959 | Allen et al. | |
| 3,023,600 | A | | 3/1962 | Stahl et al. | |
| 3,023,602 | A | | 3/1962 | Foote et al. | |
| 3,031,876 | A | | 5/1962 | Foote et al. | |
| 3,031,877 | A | * | 5/1962 | Foote et al. | 70/315 |
| 3,190,089 | A | * | 6/1965 | Foote et al. | 70/156 |
| 3,237,434 | A | * | 3/1966 | Jackes et al. | 70/317 |
| 3,325,203 | A | | 6/1967 | Moler | |
| 3,429,153 | A | | 2/1969 | Magyar | |
| 3,447,348 | A | | 6/1969 | Dauenbaugh | |
| 3,451,704 | A | | 6/1969 | Cothron | |
| 3,691,799 | A | | 9/1972 | Hoffmann et al. | |
| 3,799,594 | A | | 3/1974 | Watermann | |
| 3,890,813 | A | | 6/1975 | Cothron | |
| 3,917,330 | A | | 11/1975 | Quantz | |
| 4,125,008 | A | | 11/1978 | Genest et al. | |
| 4,194,377 | A | | 3/1980 | Maeda | |
| 4,281,525 | A | | 8/1981 | Bako | |
| 4,395,064 | A | | 7/1983 | Bellot et al. | |
| 4,414,828 | A | | 11/1983 | Takinami et al. | |
| 4,438,964 | A | | 3/1984 | Peters | |
| 4,528,829 | A | | 7/1985 | Bert et al. | |
| 4,567,741 | A | | 2/1986 | Trempala | |
| 4,635,454 | A | | 1/1987 | Brown | |
| 4,648,253 | A | | 3/1987 | Imhoff | |
| 4,667,990 | A | | 5/1987 | Quantz | |
| 4,671,548 | A | | 6/1987 | Haberle et al. | |
| 4,682,483 | A | * | 7/1987 | Werner | 70/312 |
| 4,706,478 | A | | 11/1987 | Swan et al. | |
| 4,770,013 | A | | 9/1988 | Nakai | |
| 4,783,103 | A | | 11/1988 | Schlegel | |
| 4,838,054 | A | | 6/1989 | Weinerman et al. | |
| 4,858,456 | A | * | 8/1989 | McGee, Sr. | 70/491 |
| 4,979,384 | A | | 12/1990 | Malesko et al. | |
| 5,007,261 | A | | 4/1991 | Quantz | |
| 5,238,274 | A | | 8/1993 | Becker et al. | |
| 5,372,021 | A | | 12/1994 | Smith | |
| 5,473,922 | A | | 12/1995 | Bair et al. | |
| 5,611,224 | A | | 3/1997 | Weinerman et al. | |
| 5,918,916 | A | | 7/1999 | Kajuch | |
| 5,934,120 | A | * | 8/1999 | Kuo | 70/312 |
| 5,979,198 | A | * | 11/1999 | Haas-Trober et al. | 70/268 |
| 6,178,792 | B1 | | 1/2001 | Glazier | |
| 6,314,773 | B1 | * | 11/2001 | Miller et al. | 70/303 A |
| 6,341,513 | B1 | * | 1/2002 | Chen | 70/303 A |
| 6,345,523 | B1 | * | 2/2002 | Kuo | 70/323 |
| 6,401,505 | B1 | | 6/2002 | Kajuch et al. | |
| 6,460,708 | B2 | | 10/2002 | Dean et al. | |
| 6,622,534 | B1 | | 9/2003 | Miller et al. | |
| 6,685,242 | B2 | | 2/2004 | Furner | |
| 6,722,169 | B2 | | 4/2004 | Segawa | |
| 6,733,049 | B2 | | 5/2004 | Piorkowski et al. | |
| 7,269,984 | B2 | | 9/2007 | Jackson | |
| 7,458,239 | B1 | * | 12/2008 | Ma | 70/21 |
| 7,603,881 | B2 | | 10/2009 | Yukihara et al. | |
| 8,051,691 | B2 | * | 11/2011 | Gallo et al. | 70/389 |
| 2004/0182120 | A1 | * | 9/2004 | Flory et al. | 70/134 |
| 2006/0001275 | A1 | | 1/2006 | Plett et al. | |
| 2006/0150693 | A1 | | 7/2006 | Houlihan et al. | |
| 2007/0193318 | A1 | | 8/2007 | Churchill et al. | |
| 2008/0134735 | A1 | | 6/2008 | Gallo et al. | |
| 2008/0196460 | A1 | * | 8/2008 | Houlihan et al. | 70/285 |
| 2008/0209962 | A1 | * | 9/2008 | Peot et al. | 70/101 |
| 2009/0241619 | A1 | | 10/2009 | Kuester et al. | |
| 2010/0263418 | A1 | | 10/2010 | Moon | |
| 2012/0013135 | A1 | | 1/2012 | Moon | |
| 2013/0239629 | A1 | | 9/2013 | Choy et al. | |

FOREIGN PATENT DOCUMENTS

| | | | |
|---|---|---|---|
| DE | 102005034833 | | 2/2006 |
| EP | 1617024 | | 5/2005 |
| GB | 1278129 | | 6/1972 |
| JP | 2001-271547 | | 5/2001 |
| WO | WO 2007073800 | A1 | 7/2007 |

OTHER PUBLICATIONS

International Search Report from PCT/US07/03548 mailed Jan. 9, 2008, 1 page.

Written Opinion from PCT/US07/15957 dated Jan. 9, 2008, 5 pages.

Written Opinion from PCT/US2007/003548 mailed Jan. 9, 2008, 7 pages.

Machine Translation for DE 23 42 574.

Machine Translation for EP1617024.

Letter from Christopher C. Boehm to Mr. David Grover or any individuals associated with the prosecution of U.S. Appl. No. 11/774,038 at Calfee, Halter & Griswold, Regarding U.S. Appl. No. 11/774,038. Mailed on Mar. 21, 2011. 2 pages.

Letter from David J. Grover to Mr. Christopher C. Boehm Regarding U.S. Appl. No. 11/774,038. Mailed on Mar. 28, 2011, 2 pages.

Letter from Christopher C. Boehm to Mr. David Grover Regarding U.S. Appl. No. 11/774,038. Mailed Apr. 1, 2011. 2 pages.

Email from David Grover to Christopher C. Boehm regarding U.S. Appl. No. 11/774,038. Sent on Apr. 8, 2011 at 1:04 pm. 4 pages.

Letter from Christopher C. Boehm to Mr. David Grover Regarding U.S. Appl. No. 11/774,038., Mailed on Apr. 29, 2011. 1 page.

Non-Final Office Action dated Mar. 8, 2016 for U.S. Appl. No. 13/650,456.

Non-Final Office Action dated Feb. 27, 2015 for U.S. Appl. No. 13/650,456.

* cited by examiner

COMBINATION LOCK WITH ROTARY LATCH

CROSS REFERENCE TO RELATED APPLICATIONS

This application claims the benefit of U.S. Provisional Patent Application Ser. No. 60/979,606 filed Oct. 12, 2007, the contents of which are incorporated herein by reference thereto.

BACKGROUND

This application relates generally to combination locks for lockers.

Combination locks are used to secure or lock the door of lockers, cabinets, toolboxes, desks, and other such enclosures. A low cost solution of such combination locks includes the use of spring bolts that actuate in response to entry of the correct combination. Such spring bolt combination locks eliminate the need for bulky and expensive handle mechanisms.

In many applications, the user of the combination lock changes over time. For instance, lockers in a school are often assigned to one student user for a period of time, such as a school year, and then assigned to another student in a following school year. In this example, the school often times desires to retain the ability to gain entry to the locker without need of the combination. Thus, combination locks are provided with a master key. The master key can actuate the spring bolt to open the lock without the combination. The master key, when used with a push button mechanism, changes the combination of the lock to one of several different pre-assigned combinations.

Examples of such key-controlled combination changing permutation locks are provided in U.S. Pat. Nos. 3,023,600, 3,023,602, 3,031,876, 3,031,877, and 3,190,089 to Foote et al., the contents of which are incorporated herein by reference thereto.

Prior combination locks have several disadvantages for example, prior locks having a fully retractable bolt have a less than desired bolt throw (e.g., not more than about 0.25 inches). Alternately, some prior locks have been made with longer bolt throws, but do not allow for the complete retraction of the bolt. The prior locks also provide a less than desired number of available pre-assigned combinations. Moreover, such combination locks do not avoid unauthorized entry when used in situations where the frame of the locker is capable of being bent outwardly enough to allow the bolt to no longer be engaged in the frame thus allowing the locker to be opened.

SUMMARY

In accordance with an exemplary embodiment of the present invention a combination lock is provided, the combination lock having a rotary latch configured for rotation between a locked position and an unlocked position, the rotary latch rotating in a first plane; and a bolt configured for movement between a first position and a second position along a second plane the second plane being oriented at a different location than the first plane, the bolt engaging the rotary latch in the first position such that rotation of the rotary latch from the locked position to the unlocked position is prevented.

In accordance with an exemplary embodiment of the present invention a locker is provided the locker, comprising: a door pivotally mounted to a frame of the locker; a hasp secured to the frame; a combination lock mounted to the door, the combination lock comprising a rotary latch configured for rotation between a locked position and an unlocked position, the rotary latch rotating in a first plane; and a bolt configured for movement between a first position and a second position along a second plane the second plane being oriented at a different location than the first plane, the bolt engaging the rotary latch in the first position such that rotation of the rotary latch from the locked position to the unlocked position is prevented.

In another exemplary embodiment, a method of locking and unlocking a combination lock is provided, the method comprising: biasing a rotatably mounted latch into an unlocked position, the rotatably mounted latch being mounted to a housing and is configured for rotation between a locked position and the unlocked position, the rotary latch rotating in a first plane; and biasing a bolt into a first position, the bolt being configured for movement between the first position and a second position along a second plane the second plane being oriented at a different location than the first plane, the bolt engaging the rotary latch in the first position such that rotation of the rotary latch from the locked position to the unlocked position is prevented.

The above-described and other features and advantages of the present invention will be appreciated and understood by those skilled in the art from the following detailed description, drawings, and appended claims.

BRIEF DESCRIPTION OF THE DRAWINGS

FIGS. 26 and 27 are exploded views of an alternative exemplary embodiment of the present invention.

DESCRIPTION OF THE PREFERRED EMBODIMENT

Reference is made to the following U.S. Provisional Patent Application Ser. No. 60/865,097 filed Nov. 9, 2006 and United States patent application Ser. No. 11/938,002 filed Nov. 9, 2007 the contents each of which are incorporated herein by reference thereto.

Reference is also made to the following U.S. patent application Ser. No. 11/774,038 filed Jul. 6, 2007 the contents of which is incorporated herein by reference thereto.

Figure 1:
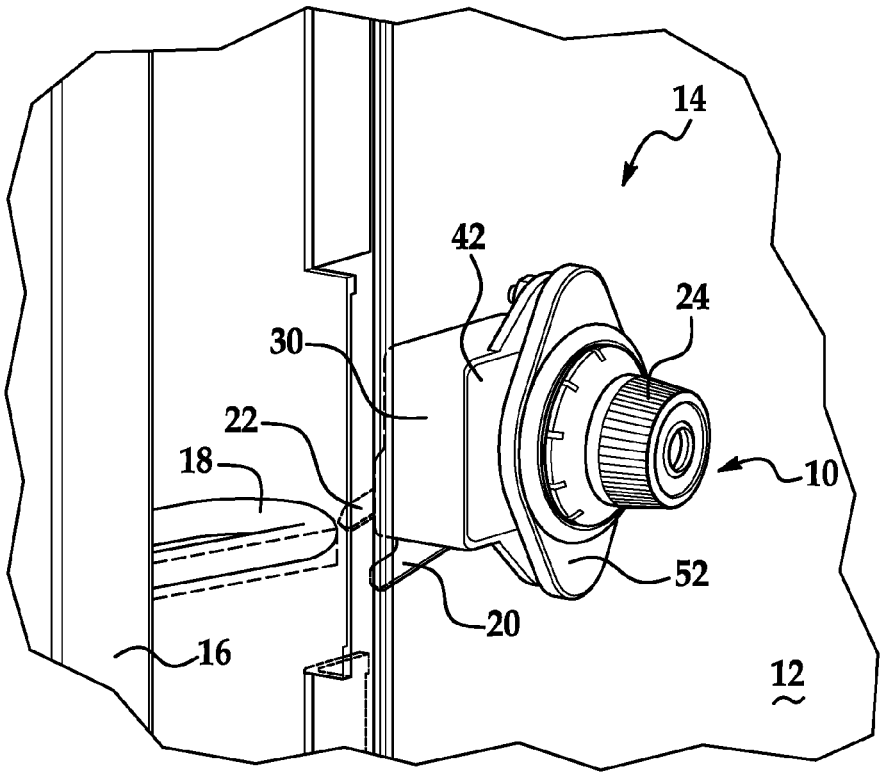
FIGS. 1 and 2 are perspective views of an exemplary embodiment of the present invention in various operational positions.
Figure 2:
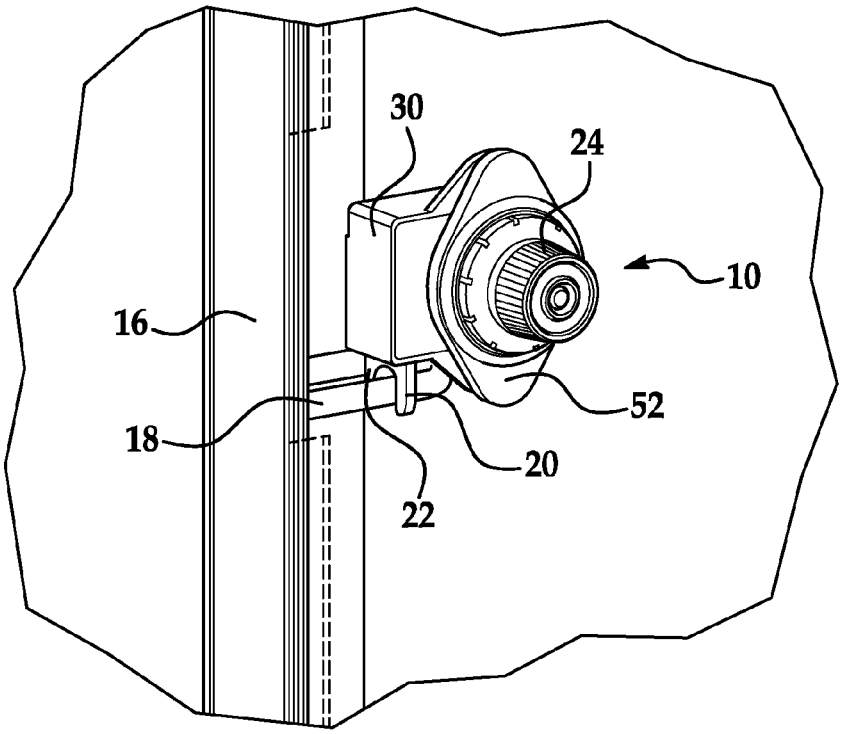

Referring now to the Figures and in particular to FIGS. 1-2, an exemplary embodiment of the present invention is illustrated. Here an improved combination changing permutation lock 10 in accordance with an exemplary embodiment of the present invention is illustrated. By way of example, lock 10 is illustrated assembled in a door 12 of a locker 14. It should be recognized that use of lock 10 is not limited to locker 14, but also finds use in other applications such as, but not limited to cabinets, toolboxes, desks, and other such enclosures.

Locker 14 includes a frame or wall 16 having a bar 18 configured to receive a rotary mounted spring-biased latch 20 of lock 10. Alternatively, and as illustrated by the dashed lines in FIG. 1 a single bar or hasp is positioned to engage the rotary mounted spring-biased latch. Although illustrated as engaging a bar or hasp below the lock, the lock and locker is contemplated to engage a bar or hasp located above or besides the housing of the lock. See for example, the embodiment of FIGS. 28-33. Rotary mounted spring-biased latch 20 is adapted to rotate from an unlatched or unlocked position (FIG. 1) to a latched or locked position (FIG. 2) wherein an opening 22 of the rotary mounted spring-biased latch 20 engages a portion of the hasp or bar 18 mounted to the locker frame and a slidable bolt engages and secures the latch 20 into the locked position.

In accordance with an exemplary embodiment of the present invention the combination of the rotary mounted spring-biased latch 20 and hasp or bar 18 provides a more robust securement of the door to the locker frame. In contrast to previous designs wherein a bolt is slid into and out of an opening in the frame of the locker, the locked locker may be breached by prying the frame away from the bolt of the lock a sufficient amount to cause the bolt to no longer be received within the opening of the frame. Moreover, the distance the bolt extends from the housing is limited due the components of the combination lock (e.g., the throw of the bolt is limited). However and in accordance with an exemplary embodiment of the present invention the rotary latch engages the hasp or bar 18.

In order to manipulate the rotary mounted spring-biased latch into the unlocked position, a correct combination is submitted via a dial 24 of the combination lock wherein a bolt of the combination lock is retracted from a blocking position and the rotary mounted spring-biased latch is spring biased into the unlocked position by a spring 26. Thereafter and in order manipulate the lock into a locked position and as the locker door having the lock mounted thereto closes the hasp or bar engages the rotary mounted spring-biased latch and overcomes the biasing force of the spring until the locked position is achieved wherein components (e.g., a bolt) of the combination lock engage or lock the rotary mounted spring-biased latch into the locked position until the correct combination is once again entered in or alternatively a key is used.

Figure 3:
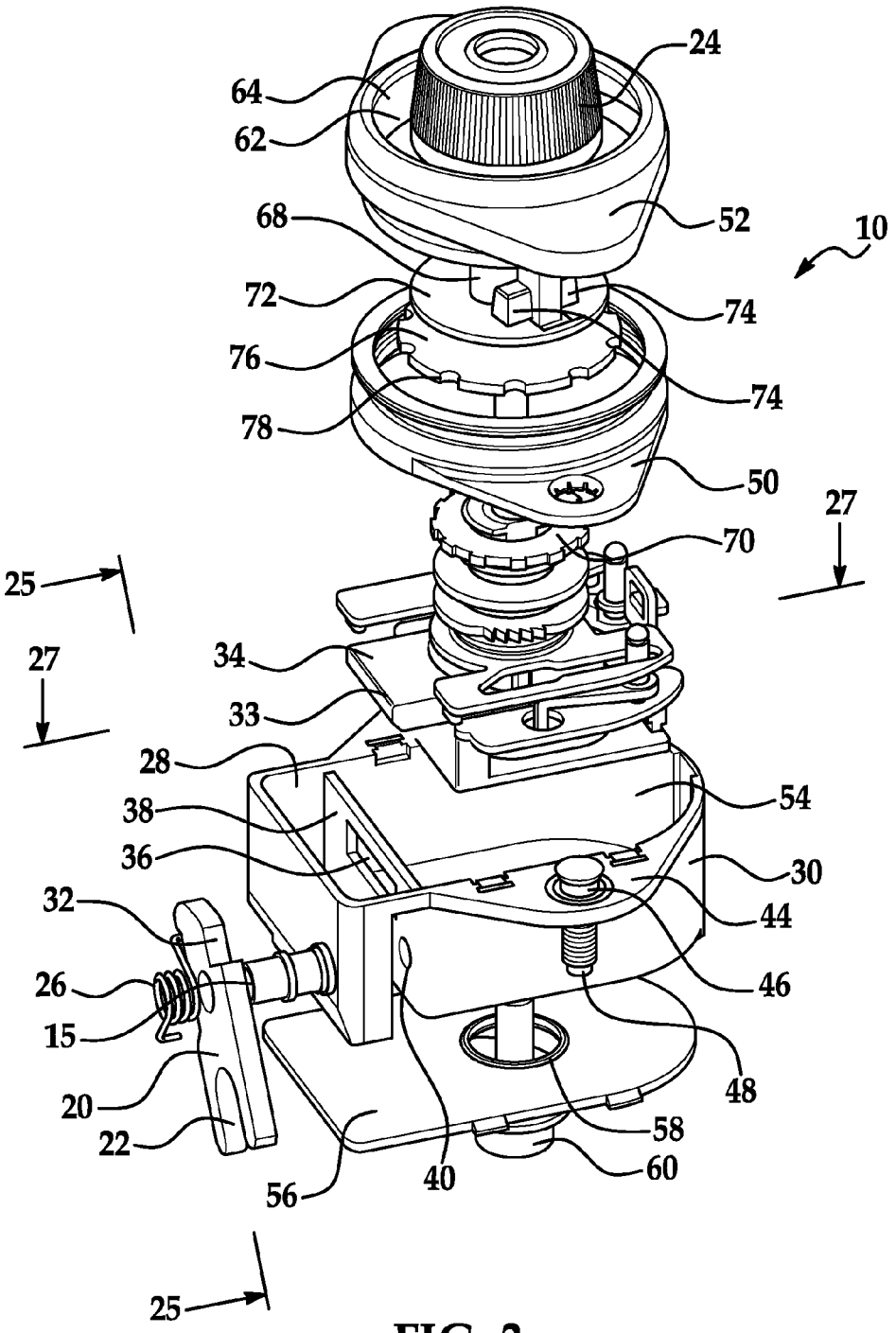
FIGS. 3 and 4 are exploded perspective views of an exemplary embodiment of the present invention.
Figure 4:
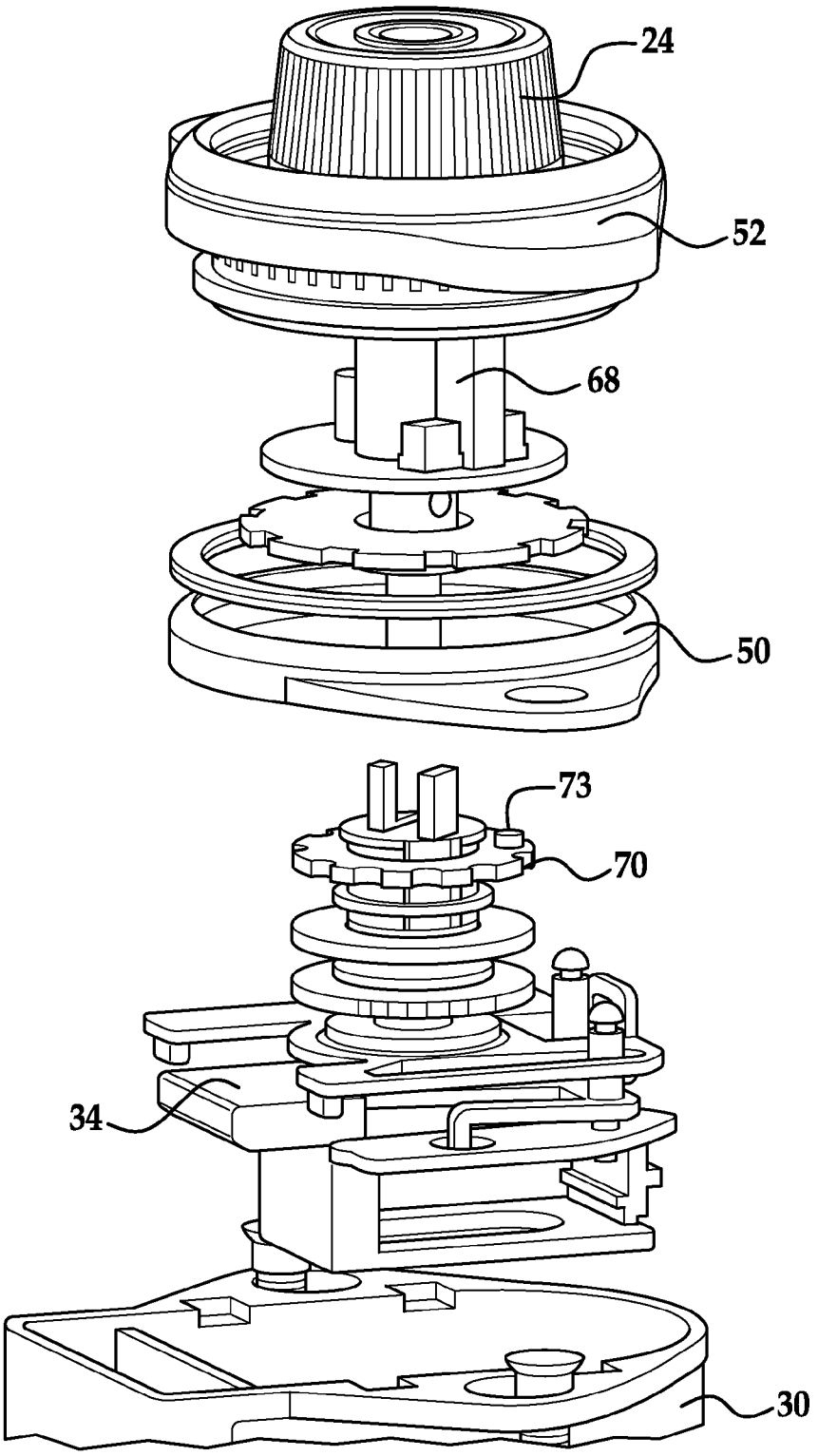
Figure 5:
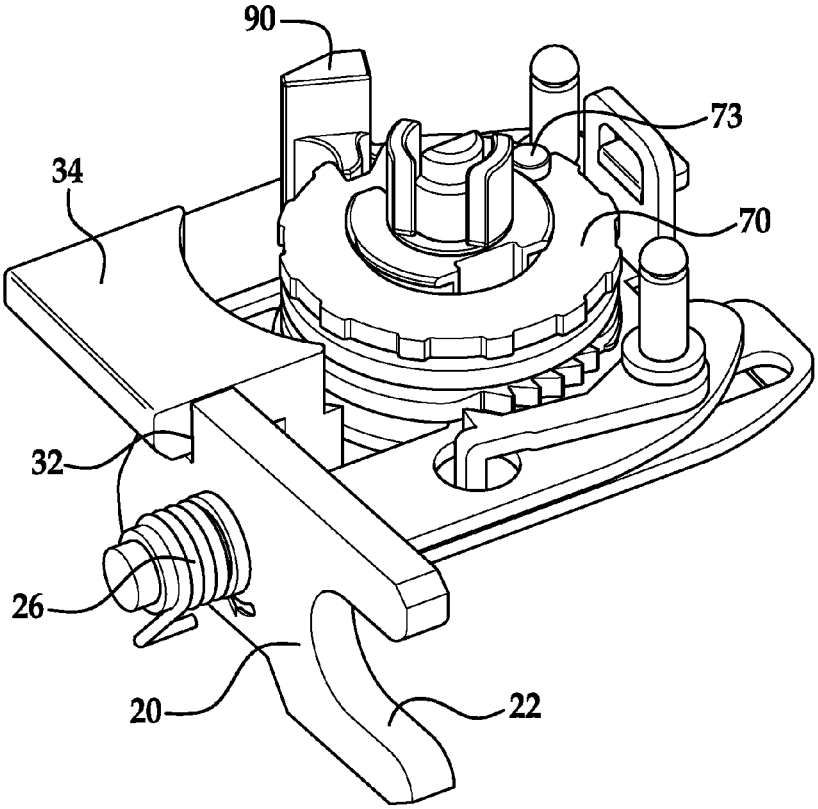
FIGS. 5-22 illustrate portions of exemplary embodiments of the present invention.
Figure 6:
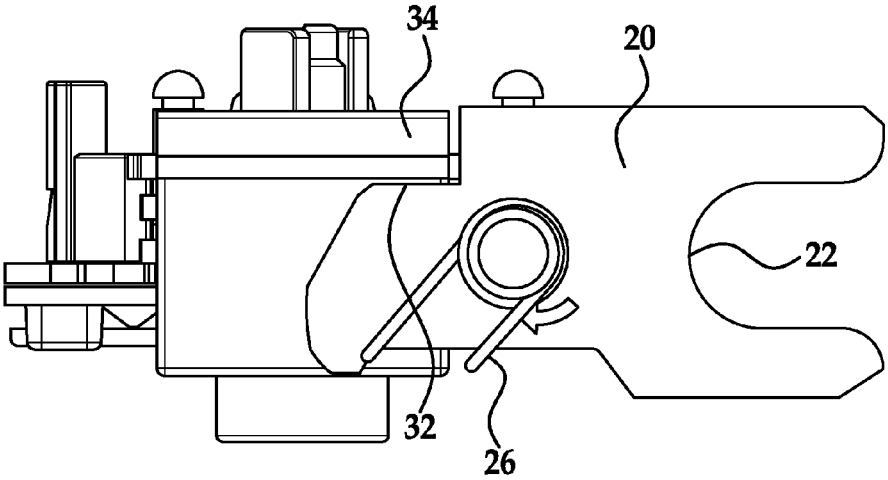
Figure 7:
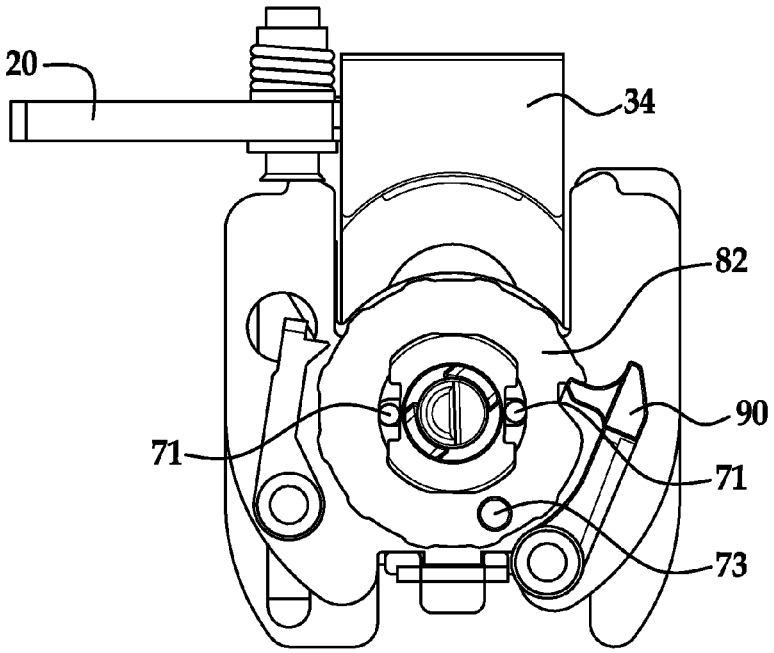
Figure 8:
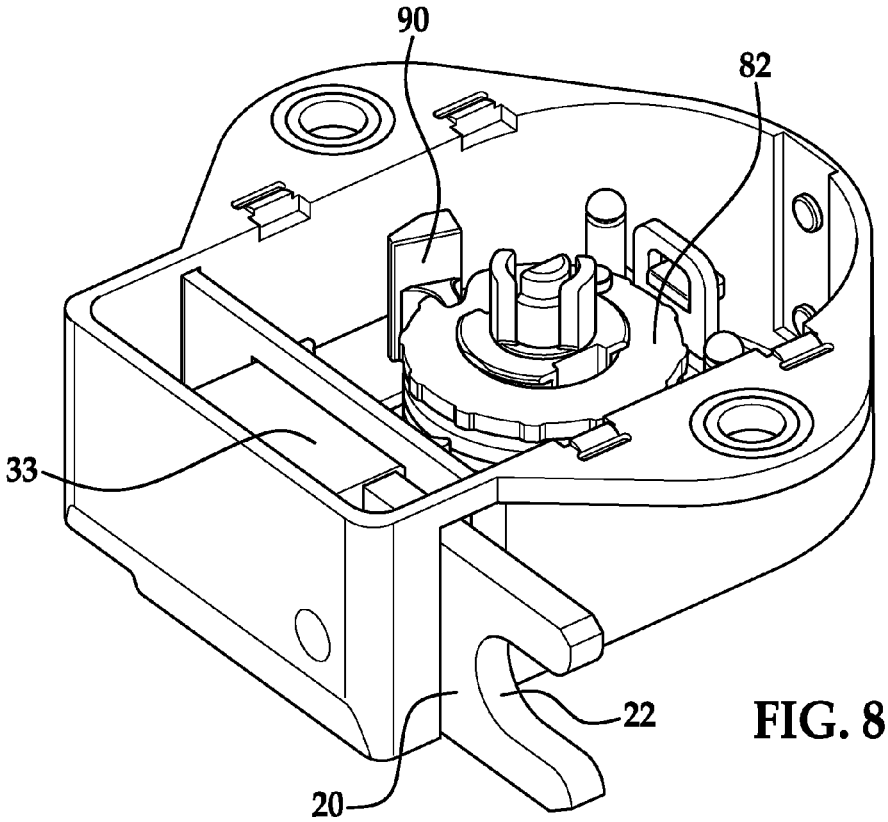
Figure 9:
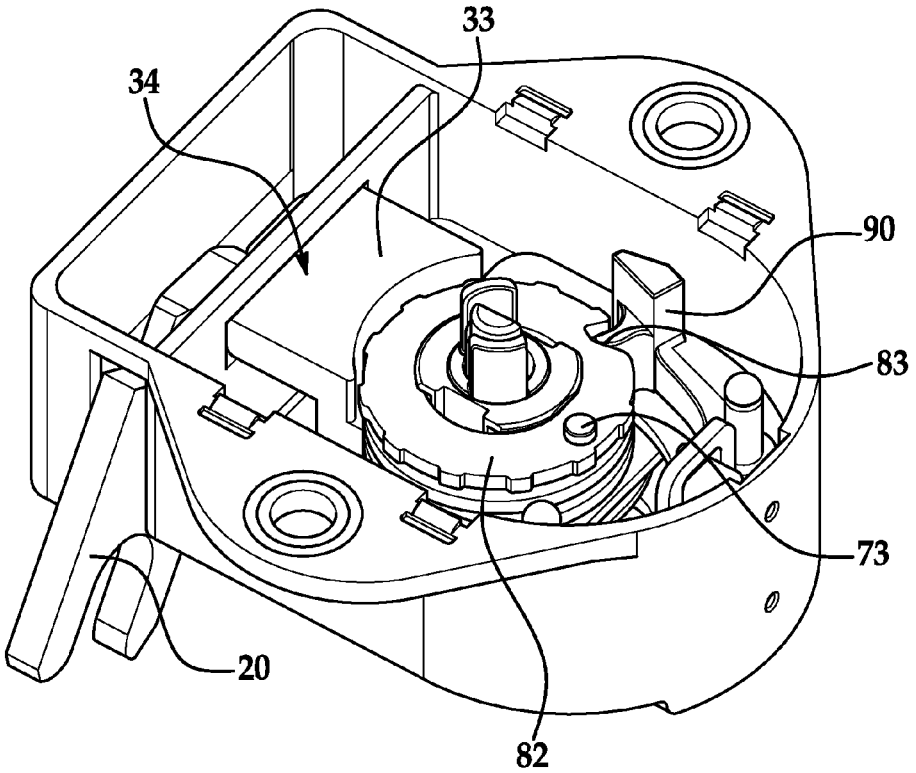
Figure 10:
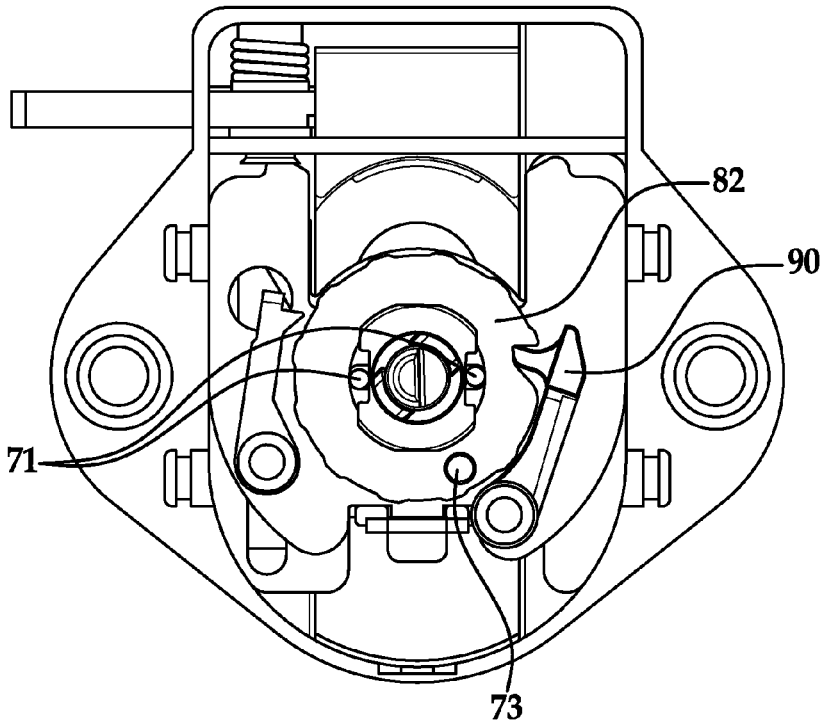
Figure 11:
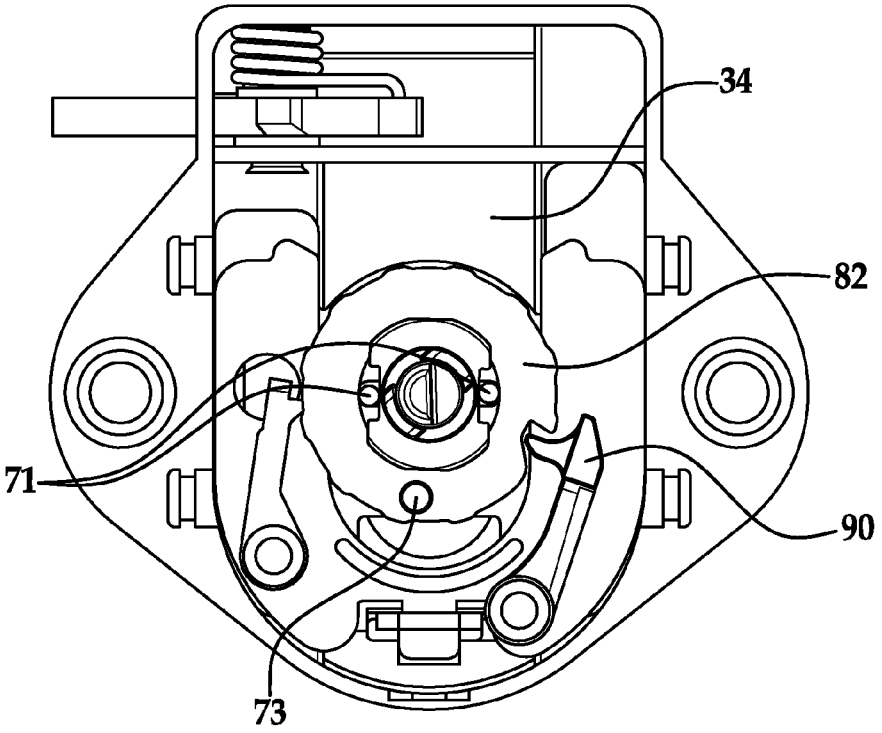
Figure 12:
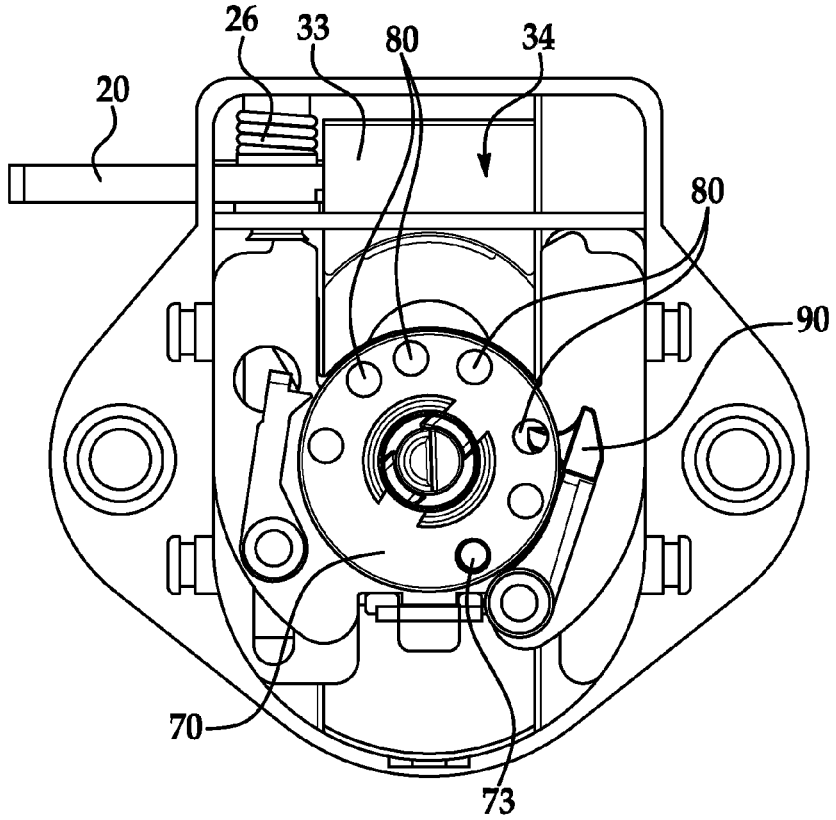
Figure 13:
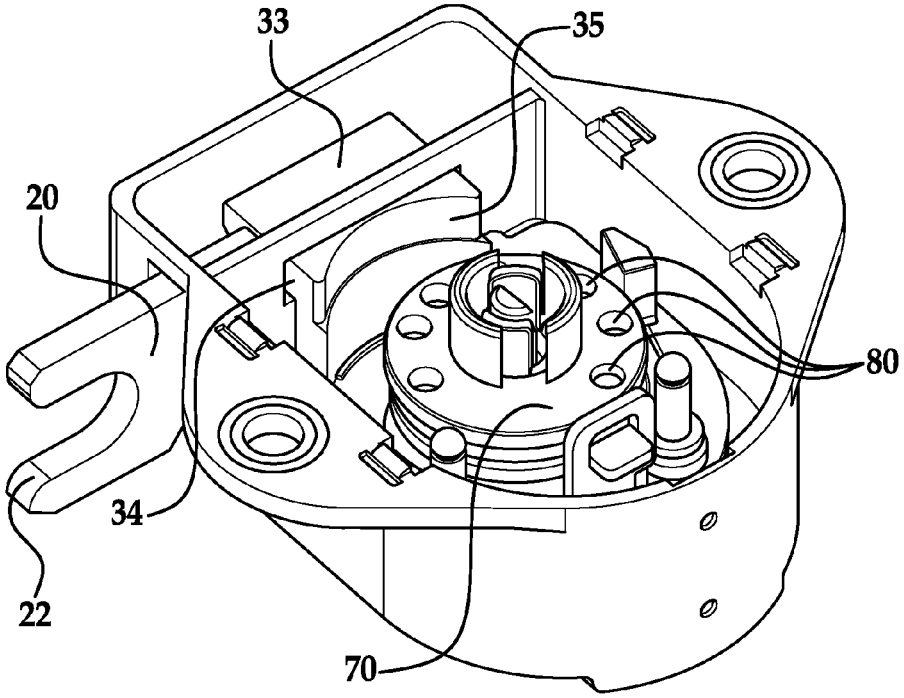
Figure 14:
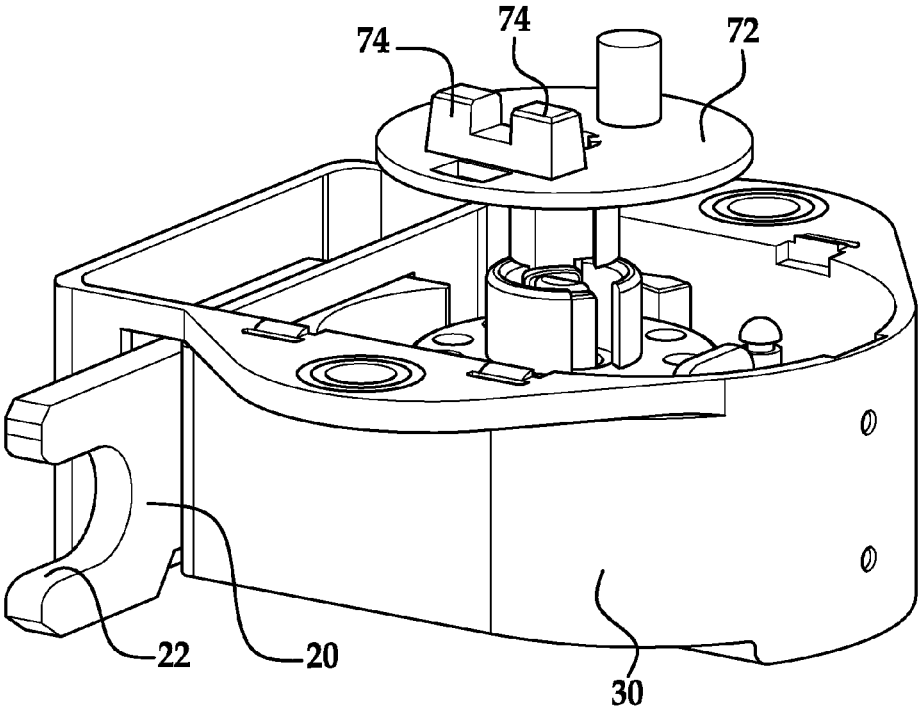
Figure 15:
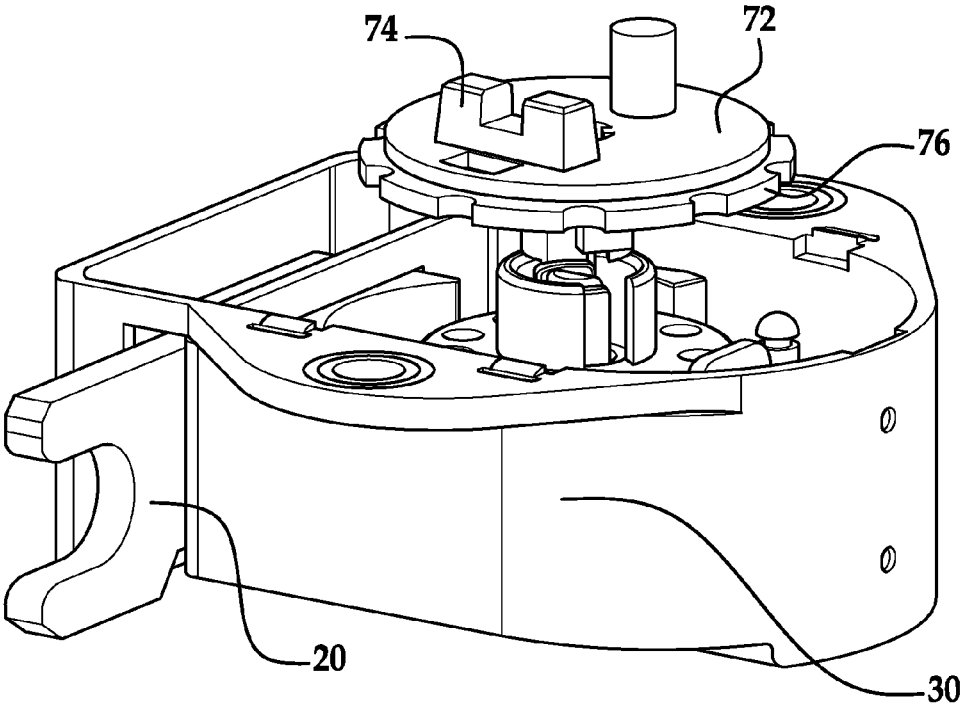
Figure 16:
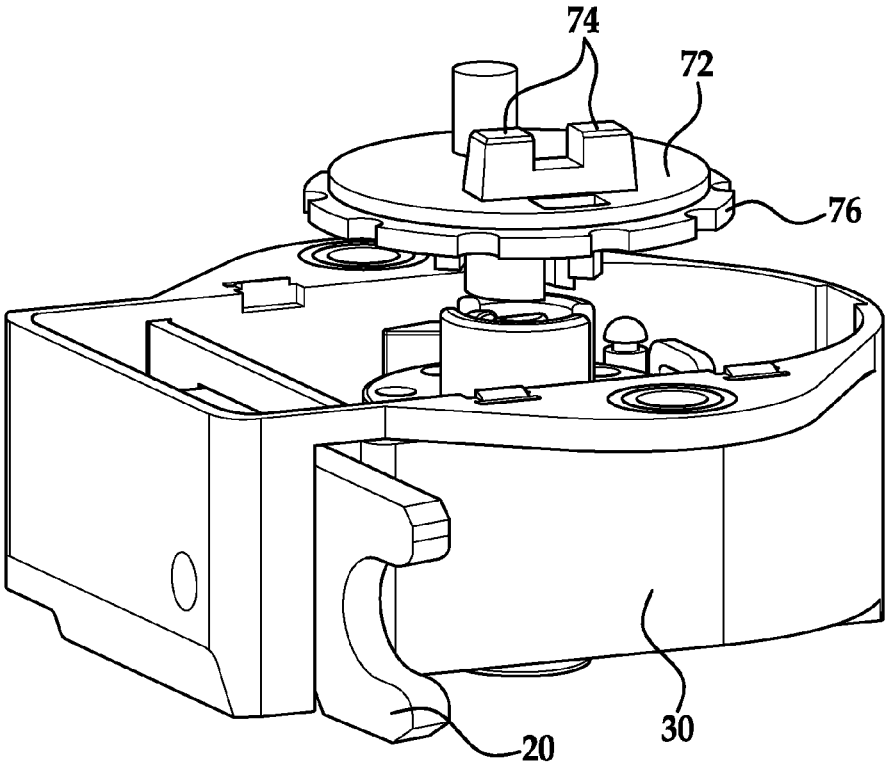
Figure 17:
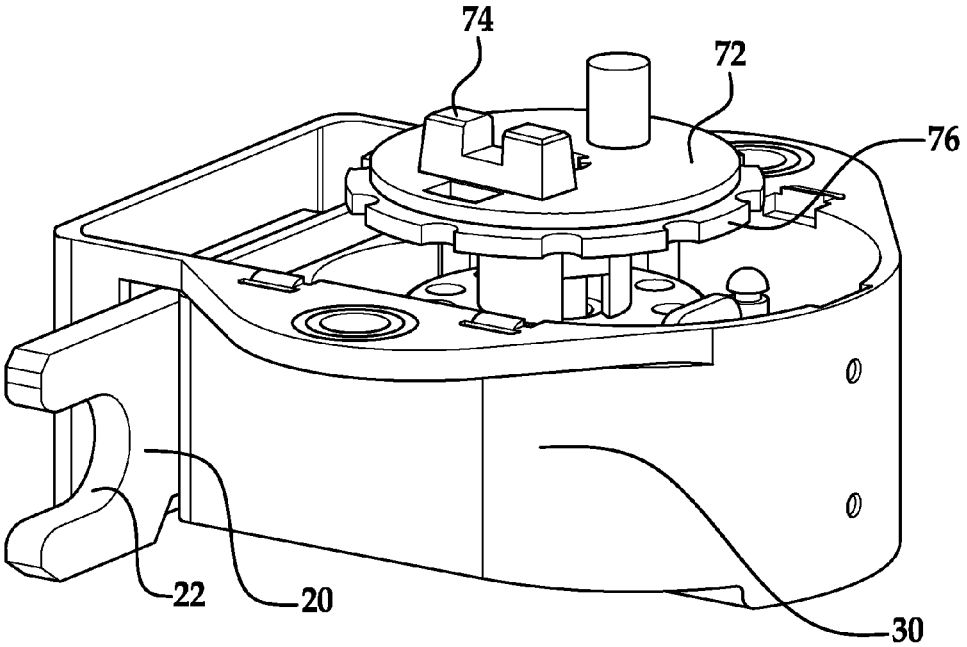
Figure 18:
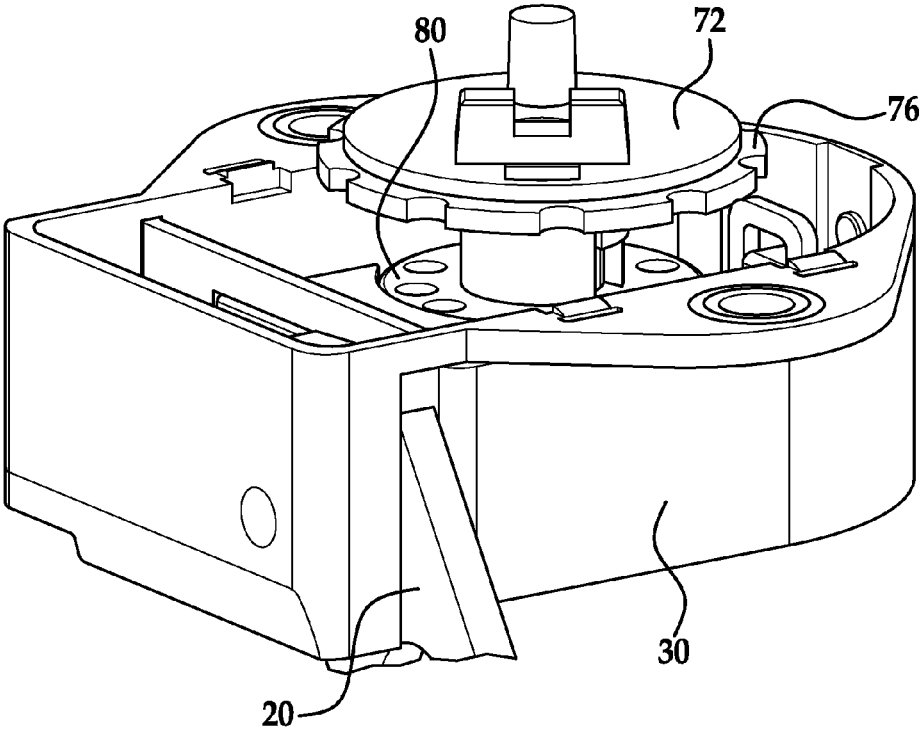
Figure 19:
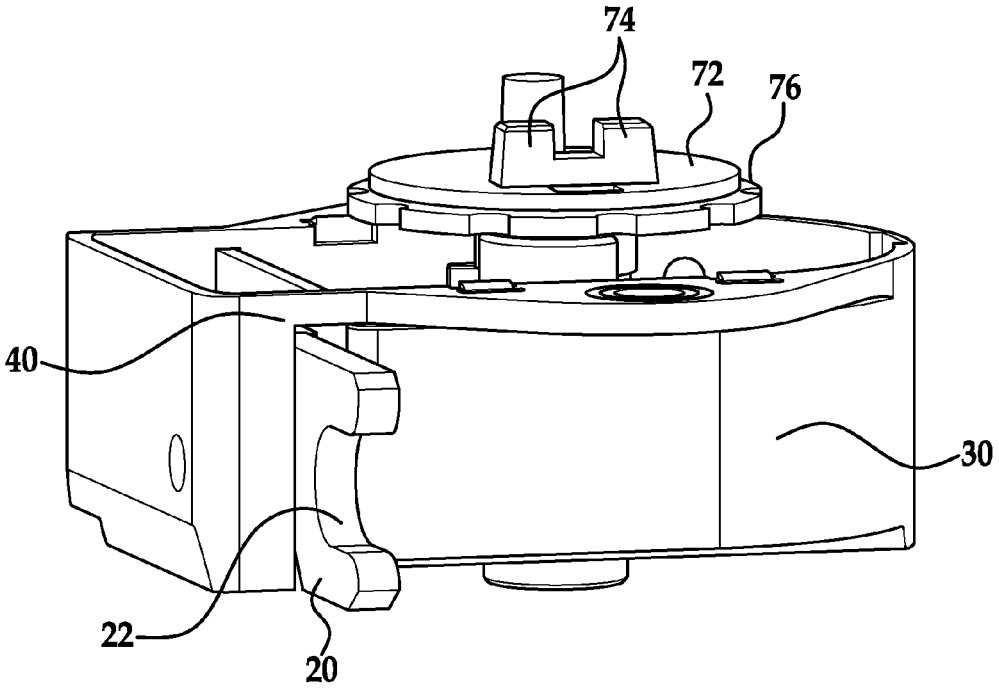
Figure 20:
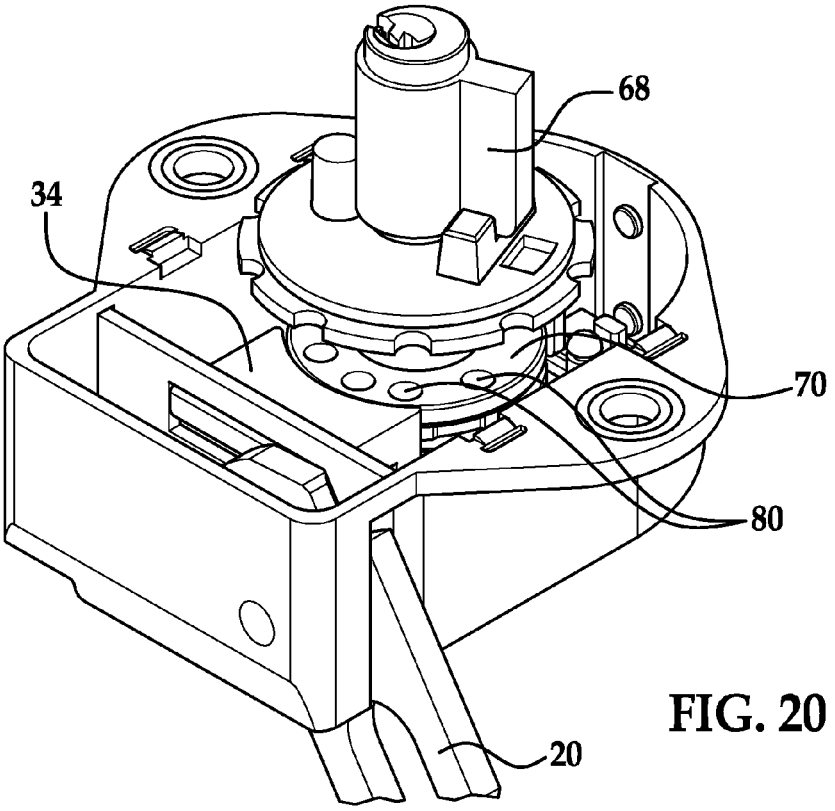
Figure 21:
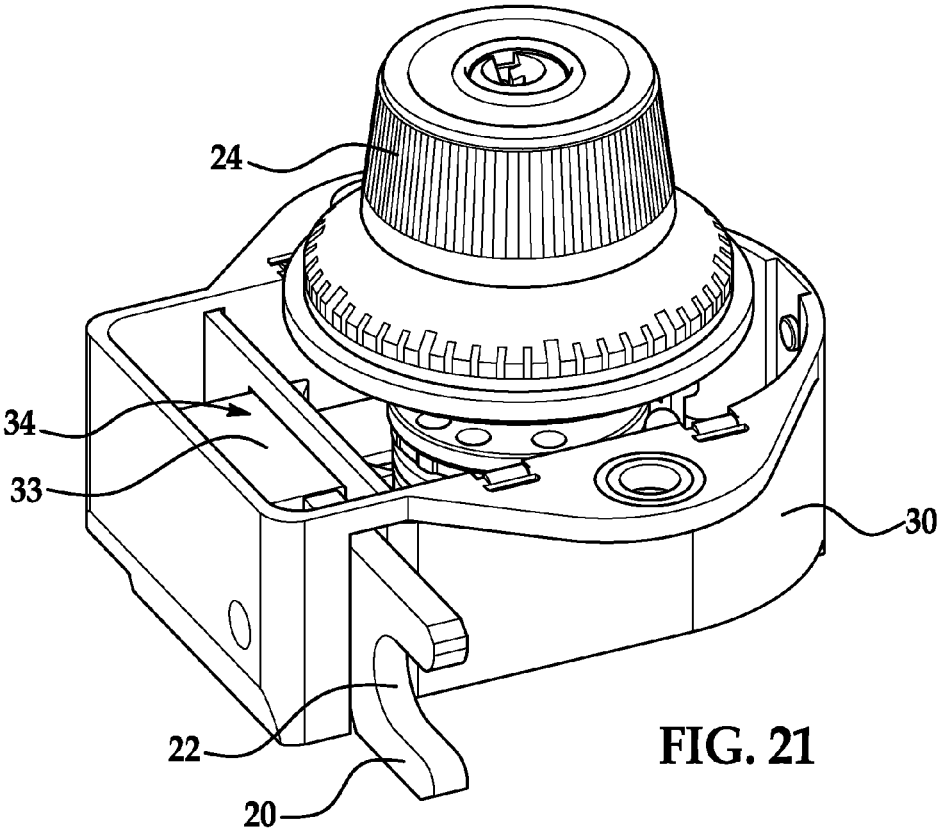
Figure 22:
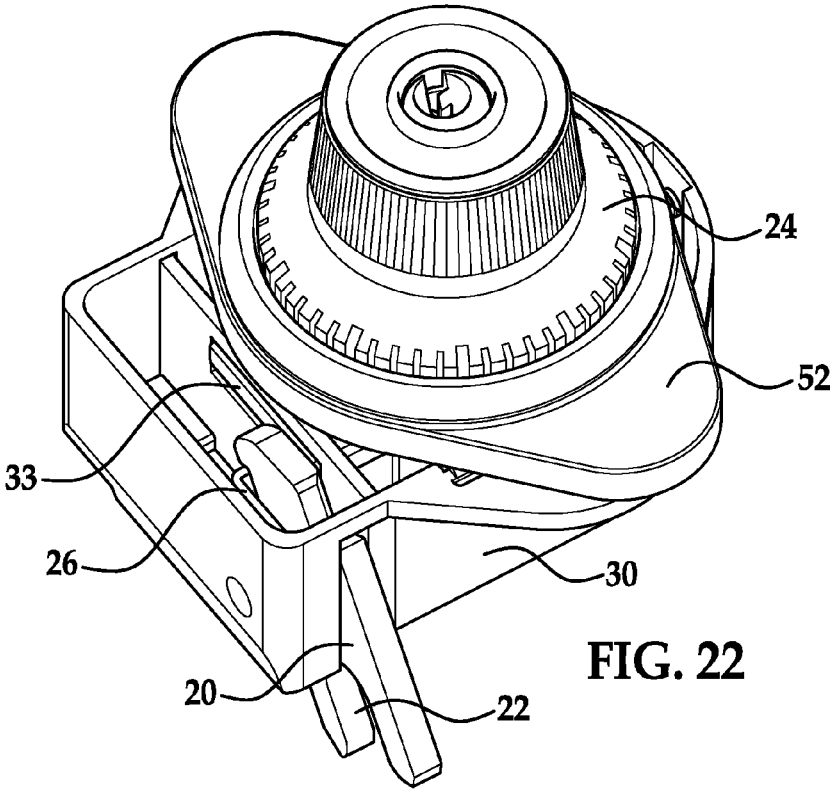
Figure 23:
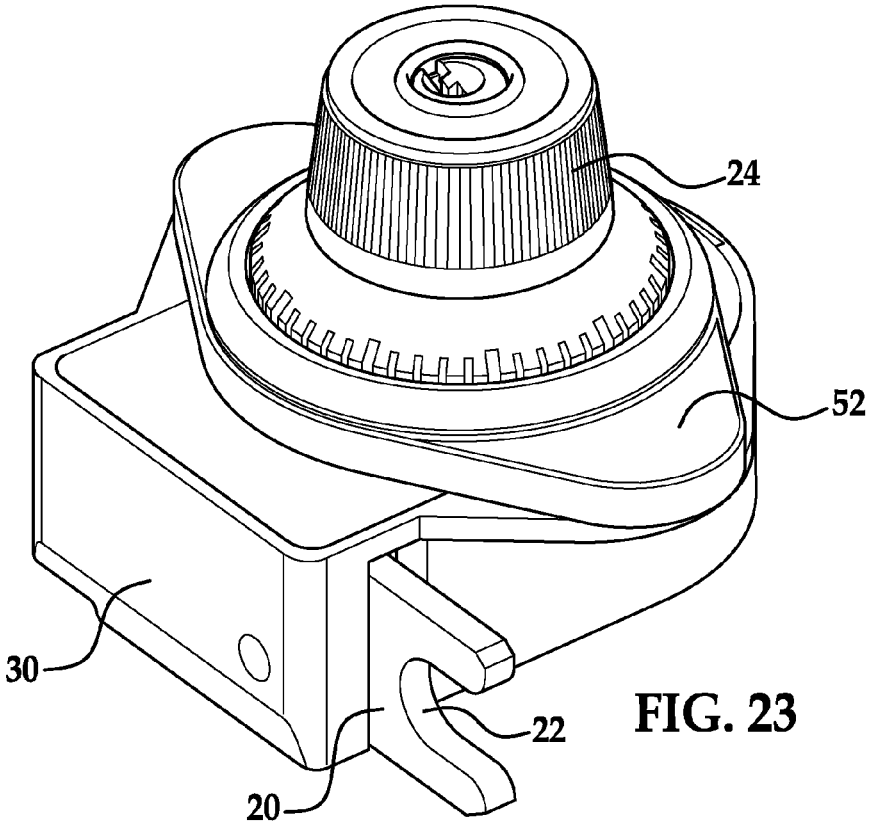
FIGS. 23-24 are perspective views of an exemplary embodiment of the present invention in various operational positions.
Figure 24:
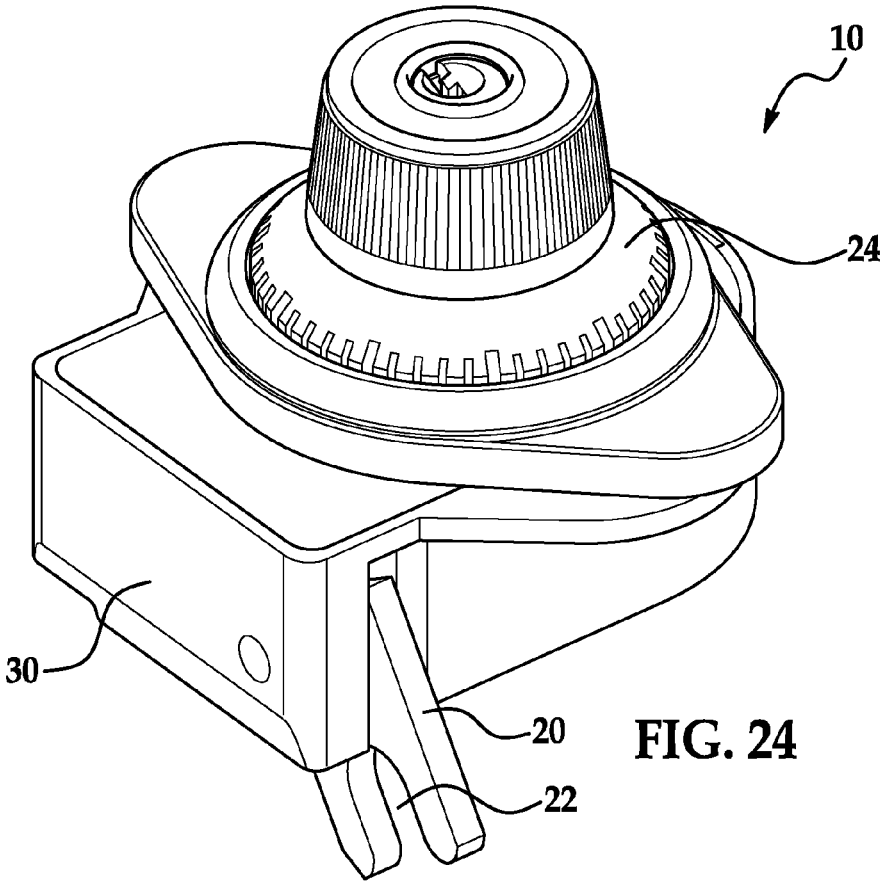
Figure 25:
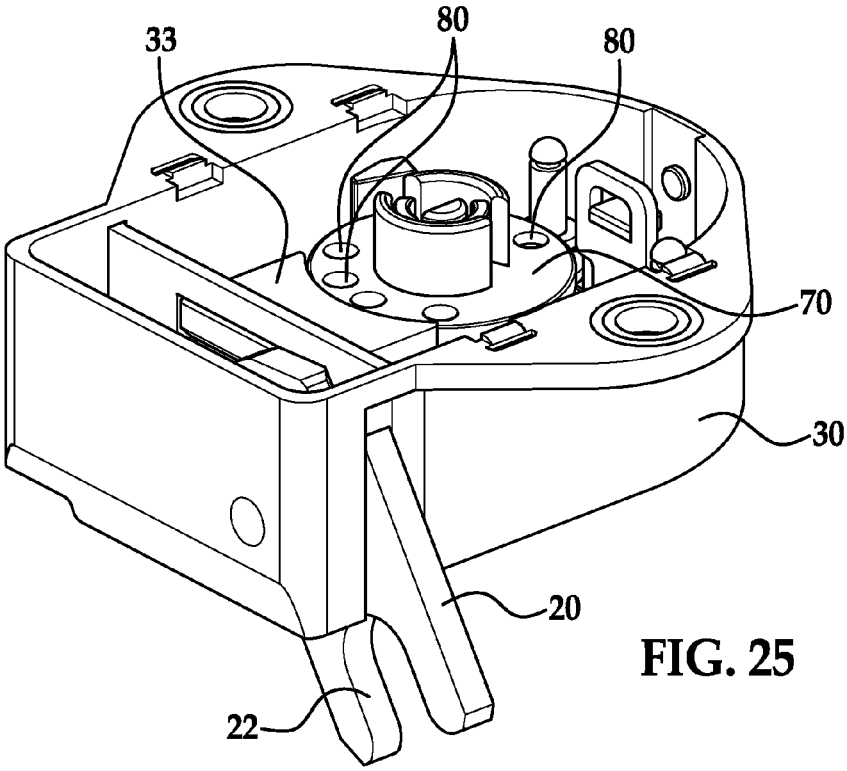
FIGS. 25-27 illustrate portions of exemplary embodiments of the present invention.
Figure 26:
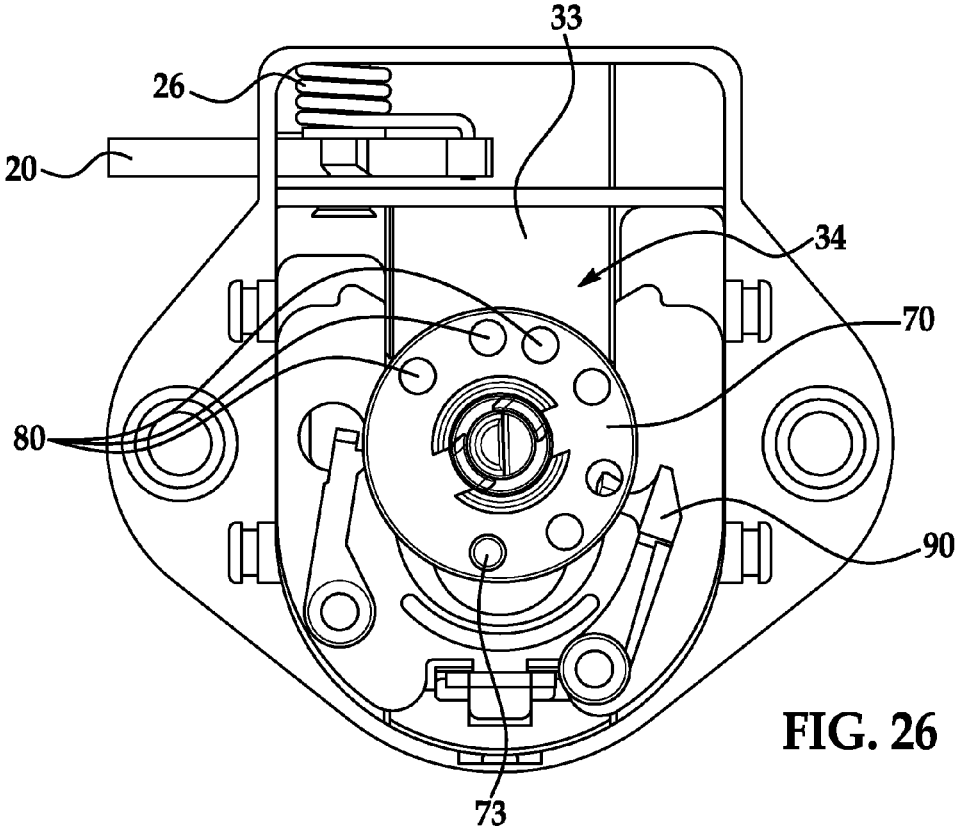
Figure 27:
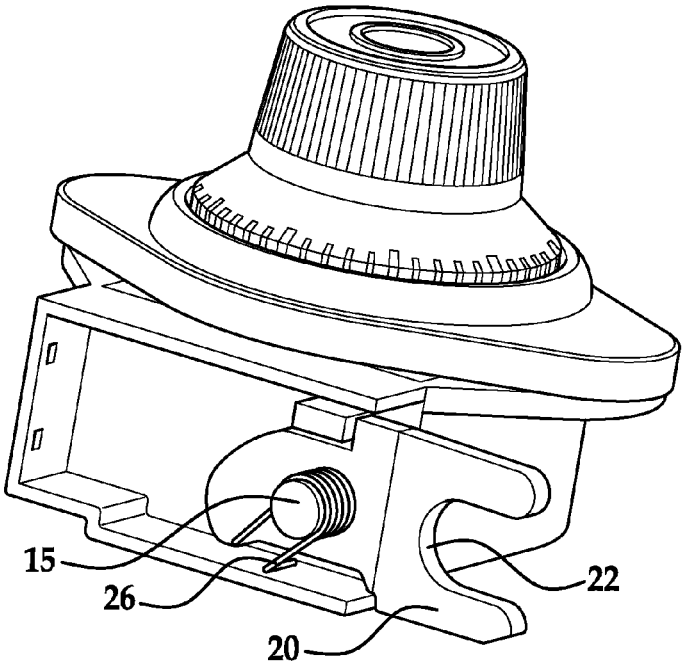
Figure 35:
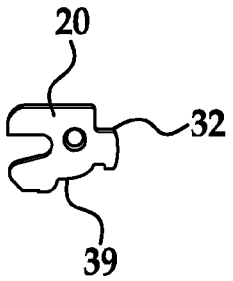

Referring now to FIGS. 1-27 an exemplary embodiment of the rotary mounted spring-biased latch is illustrated. In the various Figures components of the lock are shown in various views partially assembled, exploded views and views with components removed or relocated for ease of explanation. The rotary mounted spring-biased latch is rotatably received and mounted in a cavity 28 of a housing 30 of the lock. The rotary mounted spring-biased latch is rotatably mounted to a latch pin 15 located in cavity 28 or any other suitable location. The spring 26 engages the latch and provides a biasing force that rotates the latch into the unlocked position. It is noted that FIG. 3 illustrates the rotary mounted latch, latch pin and spring outside of cavity 28 for illustrative purposes. The biasing spring for the rotary latch can be located anywhere as long as it engages the rotary latch to provide the biasing force. For example and in one embodiment, the rotary motion of the rotary latch is on a latch hardened steel pin 15 that is encased into a housing with a knurled end on the pin, and latch spring is located on that pin. Also, the rotary latch (except for the engagement portions) is encased in the housing to prevent any abuse to components. FIG. 35 illustrates a notch 39 configured to engage an end of spring 26. In one alternative, the latch pin has a bushing mounted thereto with a feature to allow rotation of the latch thereon and a washer, if necessary is also disposed on the latch pin.

Figure 34:
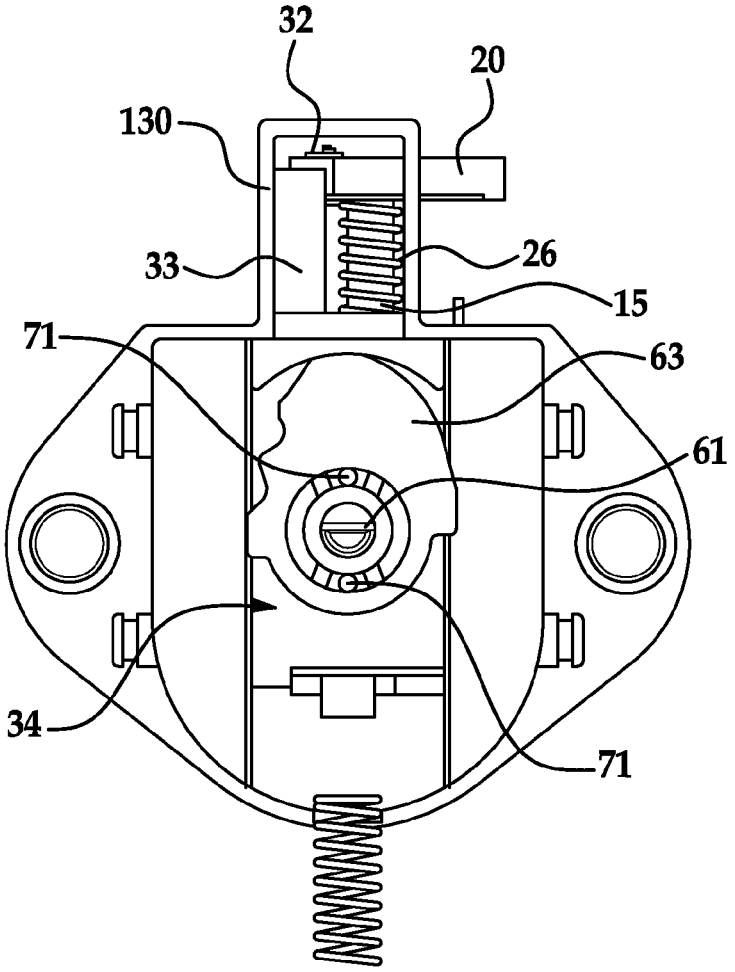

In one embodiment, latch 20 further comprises a notch, slot or shoulder portion 32 configured to engage a portion 33 of a bolt 34 of the lock when the latch is in the locked position. Portion 33 of bolt 34 is configured to slide into and out of cavity 28 by passing though an opening 36 disposed in an inner wall 38 of housing 30 that defines cavity 28. Lock 10 is configured such that upon entry of the correct combination bolt 34 is retracted from a first position wherein the bolt engages the notch of the latch and prevents the latch from rotating away from the locked position to a second position wherein the bolt is no longer in the cavity 28 or slightly moved out of cavity 28 and the latch is free to rotate into the unlocking position by spring 36 since portion 33 of bolt 34 no longer engages notch 32 of latch 20. FIG. 34 illustrates a smaller portion 33 of bolt 24 received within cavity 130.

In accordance with an exemplary embodiment of the present invention bolt 34 is also biased into the first position by at least one spring member. In order to overcome this biasing force an operator by providing the correct combination to the combination lock will then be able to rotate a dial of the lock wherein bolt 34 is retracted from the first position to the second position and the latch is free to rotate into the unlocked position. Alternatively, a key is used. It is noted that operation of the bolt (e.g., movement back and forth), and combination lock is in one embodiment similar to that illustrated U.S. Pat. No. 3,190,089 to Foote et al. the contents of which are incorporated herein by reference thereto. For example, bolt 34 is similar to the bolt illustrated in FIGS. 3-8 and 3-14 of U.S. Pat. No. 3,190,089 except that the bolt moves within the housing of the lock and the surface of portion 33 of the bolt is configured to release and engage a complimentary portion 32 of the spring biased rotary latch of exemplary embodiments of the present invention. Thus, movement of the bolt in the housing allows the latch to be engaged (locked) and disengaged (released or unlocked). Moreover, the operation of the combination lock mechanism, master key operation and lock changing capabilities are similar to those illustrated in U.S. Pat. No. 3,190,089.

In accordance with an exemplary embodiment of the present invention the latch rotates in a first plane 25 of rotation while the bolt slides in a second plane 27. In one exemplary embodiment, the first plane of rotation is perpendicular to the second plane. In alternative exemplary embodiments, the planes may be any other configuration including those in non-perpendicular orientations as long as the desired effect is achieved.

In accordance with an exemplary embodiment of the present invention the extended housing 30 or 130 has a slot or opening 40 through which a portion of latch 20 is able to rotate from the locked position to the unlocked position. Thus, protecting most of the components associated with the rotary latch from abuse during use as only a portion of the latch extends out of the housing during its movement from the locking to unlocking positions. In addition, smooth operation of the latch is ensured. In accordance with an exemplary embodiment of the present invention, a portion of the rotary latch is encased within the housing and a portion containing the latch opening extends out from the housing as the latch rotates from the locked position to the unlocked position wherein a portion moved within opening 40.

In one exemplary embodiment, lock 10 further comprises a cover 42 for housing 30. Housing 30 has a pair of ears 44 each having a bore 46 defined therein. Bore 46 is adapted to receive a threaded stud or bolts 48 secured to a base plate 50 that is covered by a cover plate 52.

Housing 30 further defines a cavity 54 for receiving component parts of lock 10 illustrated in detail in the attached Figures. As discussed above, wall 38 separates cavity 54 and cavity 28 of housing 30. As discussed above wall 38 has a slot through which the bolt is adapted to extend and retract. Of course, the housing 30 or 130 may be configured without wall 38. Housing 30 further comprises a back plate 56 with a hole or opening 58 through which a button 60 extends. In one exemplary embodiment button 60 has a shaft portion 61 and a cam portion 63 wherein use of master key will cause the same to rotate and the cam portion will act on a portion of the bolt and cause the bolt to slide out of the blocking position (See for example FIG. 34). Back plate 56 is configured to be secured to housing 30. Cover plate 52 also includes a dial bore 62 having a circumferential lip 64.

Referring now to Figures, the operation of lock 10 is described. For simplicity, lock 10 is described herein as a three-digit combination lock. Of course and as other applications require, lock 10 having more or less than three-digits is considered within the scope of the present invention.

Lock 10 includes a keyed locking cylinder 68 secured in dial 24. Locking cylinder 68 is actuatable by a master key 69 such that rotation of the key rotates cam portion of embodiment button 60 thus retracts bolt, thus opening lock 10 by allowing the latch to rotate into the unlocked position. Accordingly, lock 10 is openable by both a combination and a master key. For example, a student assigned to a locker 14 having lock 10 is provided with the combination of the lock for opening the lock, while the supervisory authorities of the school maintain the key for opening the lock as needed.

Further, the keyed locking cylinder also includes a mating portion adapted to mate with a corresponding mating portion of the button. The locking cylinder is actuatable by a master key such that rotation of the key, along with simultaneous depression of the button changes the combination of lock 10 wherein a combination plate or clutch plate 70 is able to be rotated to a different position thus, changing the combination of the lock. Accordingly, the combination of lock 10 is changeable by, for example, the supervisory authorities of the school as needed, but not by the student assigned to locker 14 having the lock thereon.

As illustrated in the Figures, the locking cylinder is prevented from rotating during rotation of the dial by a locking cylinder retainer 72. More specifically, the retainer 72 includes a pair of arms 74 adapted to mate with the locking cylinder to prevent rotation of the locking cylinder.

The retainer 72 is connected to a tumbler disc shaft that extends away from the locking cylinder. A driving plate 76 is interconnected with the tumbler disc shaft through the combination plate or clutch plate 70. Driving plate 76 includes a plurality of peripheral notches 78 and combination plate or clutch plate 70 includes a plurality of holes 80 disposed therein. Each hole 80 of the combination plate or clutch plate when positioned on a post 73 on an adjacent disk will correspond to a different combination of lock 10, thus providing lock 10 with multiple possible combinations. In order to change the combination of lock to one of a plurality of predetermined combinations, a master key is inserted into the lock cylinder and button on the back side of the housing is depressed. Again, operation of this lock changing capability is similar to that disclosed in U.S. Pat. No. 3,190,089.

For example and in one non-limiting implementation and when the master control key is inserted into the slotted plug and turned, through the engagement between the inner end of the plug and the plug extension, the combined key control cam and combination changing cam will be turned to remove the high side of the cam from a protuberance on the bottom plate. Then the cam may be pushed forwardly axially by pressure on the externally protruding cam button 60. This inward movement of the cam is transferred to the clutch plate 70 by the axially moving pins 71. Thus, one of the openings 80 of the clutch plate is removed from engagement with a post 73 of the forward disc 82 so that a new combination for the permutation lock mechanism may be selected. As will be evident, the clutch plate 70 and operation thereof is formed similarly to the clutch plate shown in FIGS. 10 and 11 of the Foote and Arnold U.S. Pat. No. 3,031,877 as well as U.S. Pat. No. 3,190,089 and includes in its peripheral portion a plurality of variably spaced apart apertures 80 adapted for selective engagement with a post 73 projecting forwardly from an outer face portion of the outermost portion of the disc 82. A compressed formed spring 75 is located between the clutch plate and a cover plate to maintain yielding contact between the clutch plate and the forward tumbler disc 82.

The tumbler disc shaft includes a plurality of notched disks 82 rotatably disposed thereon. Notched disks 82, each having at least one notch 83 configured to engage a spring biased drive lever 90 pivotally biased by springs towards the tumbler disc shaft and the notched disks. By rotating the dial right, then left and then right according to the correct combination each notched disk is independently rotated and stopped at a point where all of the notches 83 of the disks align with the drive lever and a portion of the same is received within the aligned notches of the aligned notch disks such that further rotation of the dial in the same direction as the last rotation will cause a force to be applied to the bolt such that the same is retracted into cavity 54 as a biasing force of a spring urging the bolt into cavity 28 is overcome. Thus, movement of the bolt allows the latch to rotate and unlock the lock. Again, movement of discs 82 and operation thereof is similar to that illustrated in U.S. Pat. No. 3,190,089.

Conversely, when the drive lever is no longer received within the notches of the notched disks a spring acts to extend bolt back into cavity 28 and when latch 20 is rotates bolt 34 engages notch 32 of the latch 18 thus locking the lock 10.

In accordance with one non-limiting exemplary embodiment of the present invention the bolt has a rotary latch engaging portion 33, a first leg portion 35 and a second portion 37. The first leg portion connecting the rotary latch engaging portion and the second portion wherein the second portion 37 is acted upon by the combination lock and movement of the second portion causes movement of the rotary latch engaging portion. In one non-limiting exemplary embodiment, the first leg portion is perpendicular to the second portion and the rotary latch engaging portion. Of course, other non-perpendicular configurations are contemplated. In addition and in one embodiment portion 37 has an opening disposed therein for components of the lock to be received therein. In addition and in one embodiment first leg portion 35 is configured to have an angular configuration such that the same has a configuration similar to the discs of the locking mechanism in order to allow for a range of movement of the bolt.

Lock 10 is configured to provide an increased strength to combination locks simply having a bolt extending and retracting in one plane or direction.

Referring now to FIGS. 28 to 33 an alternative exemplary environment of the present invention is illustrated. Here component parts performing similar functions are labeled with like reference numerals to those of the embodiment of FIGS. 1 through 27. In the various Figures components of the lock are shown in various views partially assembled, exploded views and view with components removed or relocated for ease of explanation. As illustrated in FIGS. 28 through 33, the housing portion 30 has an extended housing portion 130 into which the rotary mounted latch 20 is received. In one embodiment housing portion 130 is a small rectangular portion that extends from a portion of the housing. As illustrated, latch 20 has a portion that rotates within a slot or opening 40 housing portion 130. In this embodiment housing portion 130 extends away from a sidewall portion of 131 of housing 30 to provide an extended reach of latch 20. Moreover and by enclosing the shaft of latch 20 within extended housing portion 130 interference with the operation of the mechanism is prevented. In addition, the pin, spring and bolt portions are all protected in housing 130 that has a small limited profile suitable for use in lockers having very little room or real estate for lock components.

Also shown in FIGS. 28 through 33, is a button protection feature 160. Button protection feature 160 extends away from a bottom surface of the housing 30 proximate to the location of button 60 such that inadvertent actuation of button 60 due to oversized or a large amount of articles stored in the locker when the locker door having a combination lock secured thereto is closed and is opened using the master key. In other words, the master key can be used to open the lock in lieu of the combination and the master key can also be used to change the combination when the master key is inserted therein and the button 60 is depressed. Thus, when a locker is over stuffed with books and other items and the master key is used to open the locker the combination is not inadvertently changed since the button protector 160 is positioned and configured to prevent the button from being depressed by objects in the locker when the master key is used to open it up since the button 60 is on the back side of the lock. As illustrated, button protection feature 160 has an angled surface and is positioned proximate to one side of button 60. Of course other configurations are contemplated for example button protection feature 160 may be located all around the periphery of the opening receiving button 60 or alternatively only a portion of the periphery of the opening receiving button 60 and the button protection feature may be configured with or without an angled surface as long as it extends away from the bottom surface of the housing a sufficient distance so as to prevent inadvertent actuation of button 60 as discussed above.

Figure 28:
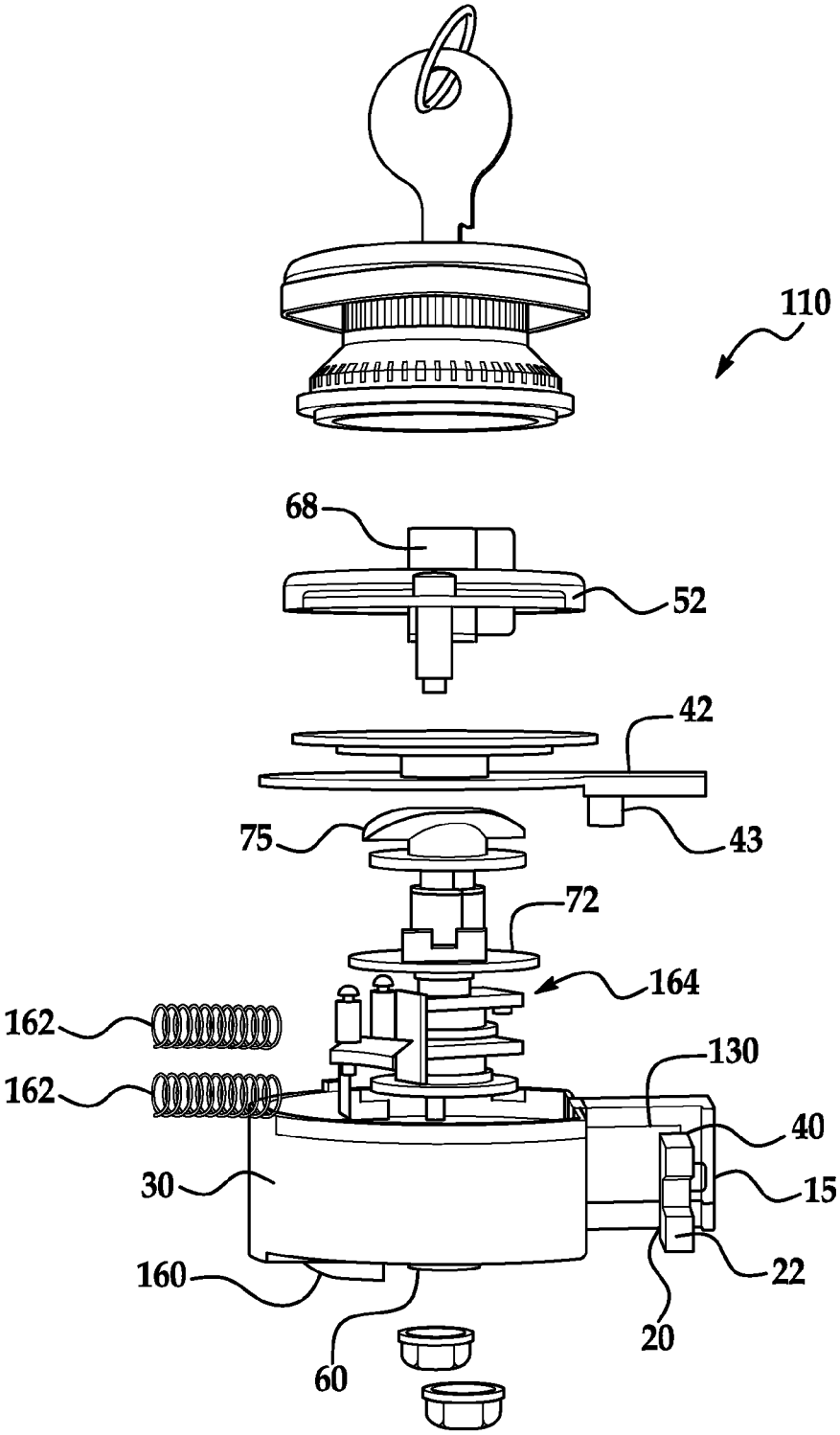
Figure 32:
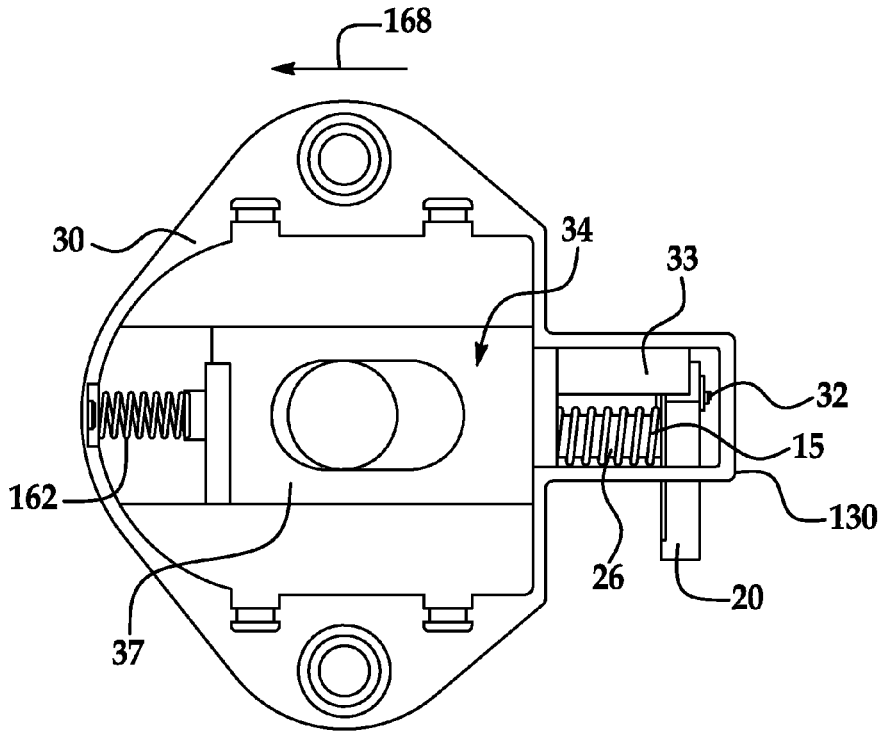
Figure 33:
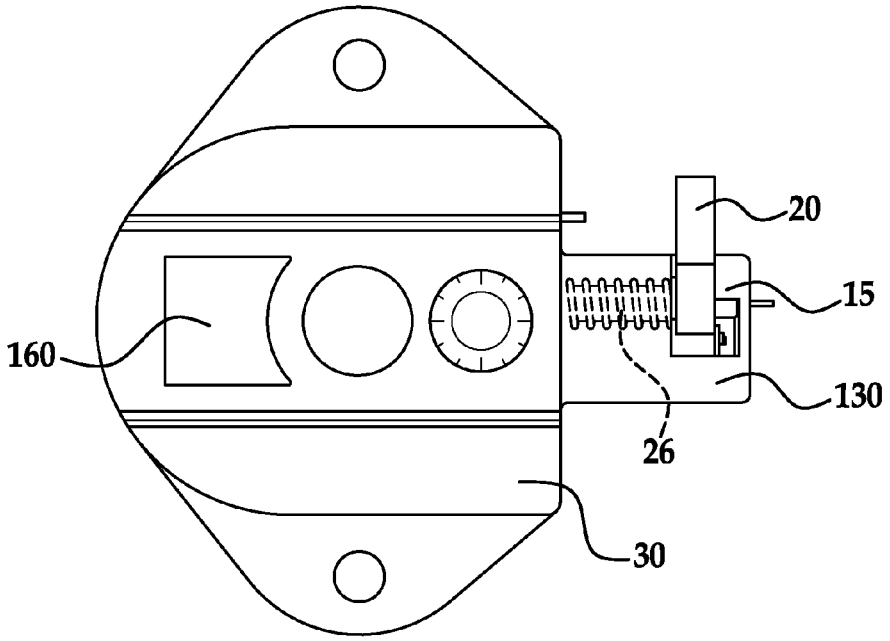

Also shown in at least FIGS. 28 and 32, a pair of biasing members or springs 162 are provided for providing a biasing forced to bolt 34 and a portion of the combination lock mechanism. As illustrated in FIG. 32 one of the biasing members 162 is positioned between bolt 34 and an inner surface of housing 30.

Referring in general to FIGS. 1 through 33 a combination lock mechanism 164 for providing a biasing force to bolt 34 in the direction of arrow 168 when the correct combination has been provided and in order to remove portion 33 from rotatable latch 20 is illustrated. In general, combination lock mechanism 164 will have a plurality of notched discs 82 each having a notch 83 that are aligned when the correct combination is provided such that the spring biased drive lever 90 will be received in each of the aligned notches 83 and rotation of the dial in a clockwise direction will cause rotation all of the plurality of notched discs and apply a resulting force to lever 90 such that a cam surface engages a portion of bolt 34 such that the same is moved in the direction of arrow 168 in order to overcome the biasing force of spring 162 and remove portion 33 from its blocking configuration of rotary latch 20 such that spring 26 will cause the same to rotate from a locked positioned to an unlocked position.

As shown in at least FIG. 32 portion 33 has a smaller width than other portions of bolt 34 in order to engage a complimentary feature 32 of rotary latch 20. Portion 33 may also have a greater height to provide added strength to the contacting portions and the reduced width may also provide more room for spring 26.

Figure 29:
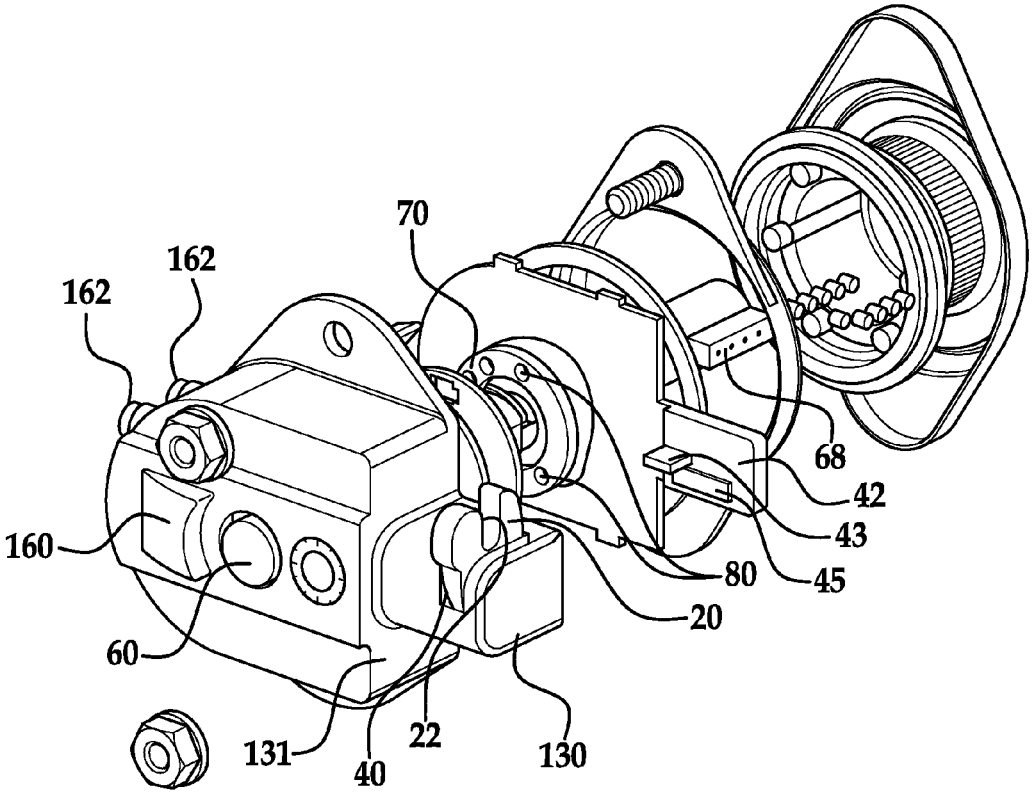
FIGS. 28-35 illustrate an alternative exemplary embodiment of the present invention.
Figure 30:
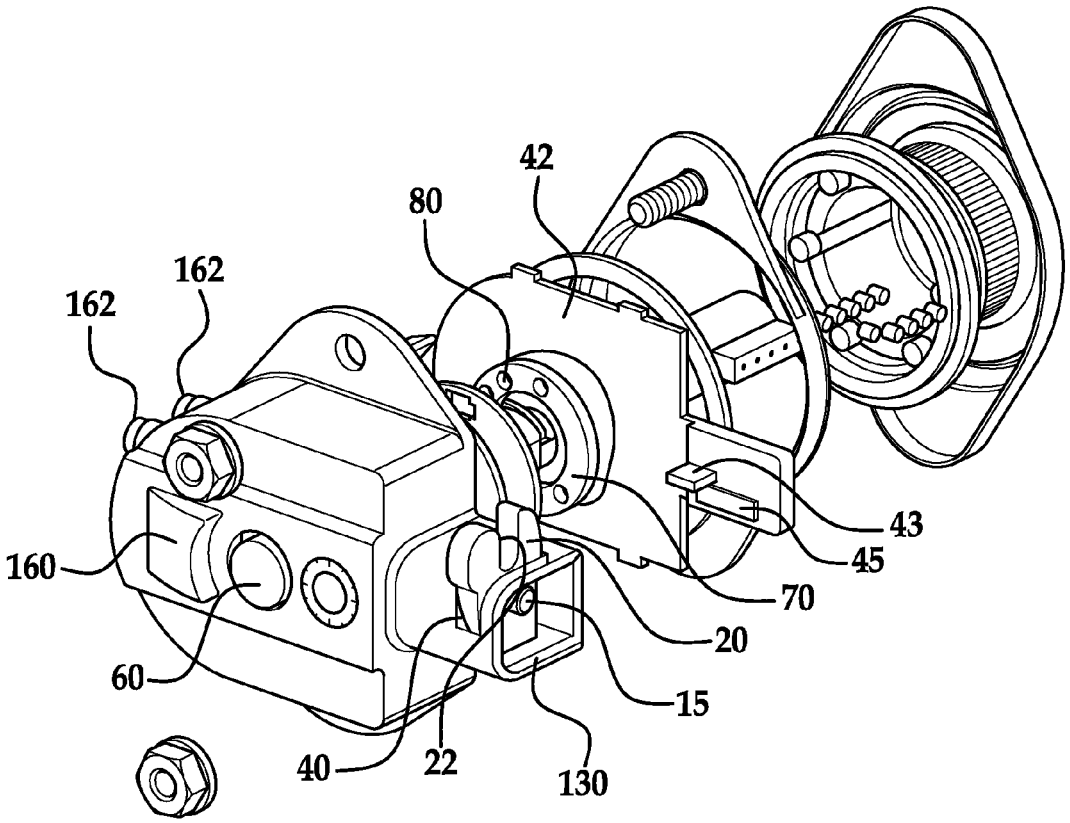
Figure 31:
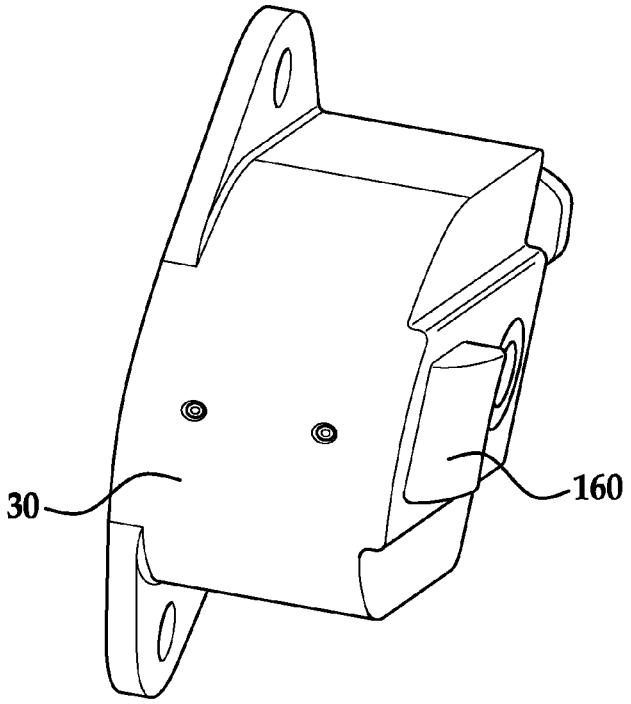

In addition and as illustrated in at least FIGS. 28-30 cover 42 further comprises a feature or protrusion 43 for guiding and preventing portion 33 of bolt from being misaligned by a force applied to latch 20 when it is engaged by portion 33. Here protrusion extends into the cavity having portion 33 and is positioned on one side of the portion of the bolt while a wall of the housing 130 is on the other side. In addition and in one additional embodiment, a back side surface of the cover will also have a feature 45 for engaging the top of portion 33 to ensure the same is not bound by a force against cover 42 and there is little room or play for the portion 33 of bolt 34 to be pushed up against cover 42 and possibly binding the movement of the same. Accordingly, cover 42 is configured to ensure portion 33 slides into an out of the locking and unlocking positions wherein the biasing force of spring 26 and other forces do not adversely affect performance of the lock (e.g., movement of bolt 34 and portion 33 either upward against cover 42 and in other lateral directions such that portion 33 of bolt 34 does not bind within the opening in the wall and/or operation of the combination lock is not adversely affected by a misaligned bolt). Of course, cover may be configured without the aforementioned features. FIGS. 32 and 34 show the lock housing without cover 42 secured thereto.

In addition and in one alternative exemplary embodiment, an edge portion of housing 30 or 130 proximate to opening 40 is configured to provide a limit of travel of rotary latch 20 as it rotates in the opening 40. Also, latch 20 may be further configured to engage a portion of the housing as it rotates between the locked position and the unlocked position.

It should also be noted that the terms "first", "second", and "third", and the like may be used herein to modify elements performing similar and/or analogous functions. These modifiers do not imply a spatial, sequential, or hierarchical order to the modified elements unless specifically stated.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A combination lock, comprising:

a rotary latch configured for rotation between a locked position and an unlocked position, the rotary latch being rotatably secured to a housing of the combination lock, wherein the rotary latch rotates in a first plane; and a bolt configured for movement between a first position and a second position along a second plane the second plane being oriented at a different location than the first plane, the bolt engaging the rotary latch in the first position such that rotation of the rotary latch from the locked position to the unlocked position is prevented, wherein the bolt is movably mounted to the housing, wherein the combination lock is a key-controlled combination changing permutation lock wherein a button disposed away from a rear exterior surface of the housing in a first direction rearwardly away from the rear exterior surface is depressed in order to change the combination of the combination lock and the housing has a button protection feature extending rearwardly away from the rear exterior surface of the housing in the first direction proximate to the button and the button protection feature extends farther away from the rear exterior surface of the housing in the first direction than the button.

2. The combination lock as in claim 1, wherein the rotary latch is spring biased into the unlocked position and the rotary latch is partially received within a portion of the housing.

3. The combination lock as in claim 1, wherein the bolt is spring biased into the first position.

4. The combination lock as in claim 1, wherein the first plane is perpendicular to the second plane.

5. The combination lock as in claim 1, wherein the rotary latch engages a hasp of a frame of a locker and the bolt only engages the rotary latch.

6. The combination lock as in claim 5, wherein the hasp is a closed loop of metal.

7. The combination lock as in claim 6, wherein the closed loop of metal extends in a plane parallel to the second plane.

8. The combination lock as in claim 1, wherein the combination lock is a key-controlled combination changing permutation lock.

9. A locker, comprising:

a door pivotally mounted to a frame of the locker, the door having a front surface and a rear surface;

a hasp secured to the frame;

a combination lock mounted to the door, the combination lock comprising a rotary latch configured for rotation between a locked position and an unlocked position, the rotary latch being rotatably secured to a housing of the combination lock, wherein the rotary latch rotates in a first plane; and a bolt configured for movement between a first position and a second position along a second plane the second plane being oriented at a different location than the first plane, the bolt engaging the rotary latch in the first position such that rotation of the rotary latch from the locked position to the unlocked position is prevented, wherein the bolt is movably mounted to the housing, wherein the combination lock is a key-controlled combination changing permutation lock wherein a button disposed away from an exterior surface of the housing in a first direction rearwardly away from the exterior surface is depressed in order to change the combination of the combination lock and the housing has a button protection feature extending rearwardly away from the exterior surface of the housing in the first direction proximate to the button and the button protection feature extends farther away from the housing in the first direction than the button, wherein the exterior surface of the housing, the button and the button protection feature extend from the rear surface of the door and the button is not accessible from the front surface of the door.

10. The locker as in claim 9, wherein the rotary latch is spring biased into the unlocked position and the rotary latch is partially received within a portion of the housing.

11. The locker as in claim 10, wherein the bolt is spring biased into the first position.

12. The locker as in claim 9, wherein the first plane is perpendicular to the second plane.

13. The locker as in claim 9, wherein the rotary latch engages the hasp and the bolt only engages the rotary latch.

14. The locker as in claim 9, wherein the hasp is a closed loop of metal.

15. The locker as in claim 14, wherein the closed loop of metal extends in a plane parallel to the second plane.

16. A method of locking and unlocking a combination lock, the method comprising:

biasing a rotatably mounted latch into an unlocked position, the rotatably mounted latch being mounted to a housing and is configured for rotation between a locked position and the unlocked position, the rotary latch being rotatably secured to a housing of the combination lock, wherein the rotary latch rotates in a first plane and the housing has a rear exterior surface; and biasing a bolt into a first position, the bolt being configured for movement between the first position and a second position along a second plane the second plane being oriented at a different location than the first plane, the bolt engaging the rotary latch in the first position such that rotation of the rotary latch from the locked position to the unlocked position is prevented, wherein the bolt is movably mounted to the housing, wherein the combination lock is a key-controlled combination changing permutation lock wherein a button disposed away from the rear exterior surface of the housing in a first direction rearwardly away from the rear exterior surface is depressed in order to change the combination of the combination lock and the housing has a button protection feature extending rearwardly away from the rear exterior surface of the housing in the first direction proximate to the button and the button protection feature extends farther away from the rear exterior surface of the housing in the first direction than the button.

17. The method as in claim 16, wherein the rotary latch is spring biased into the unlocked position and the bolt is spring biased into the first position and the first plane is perpendicular to the second plane.

* * * * *